US006836551B2

(12) United States Patent
Kuze et al.

(10) Patent No.: US 6,836,551 B2
(45) Date of Patent: Dec. 28, 2004

(54) LOUDSPEAKER

(75) Inventors: Mitsukazu Kuze, Osaka (JP); Shuji Saiki, Nara (JP); Hiroyuki Takewa, Osaka (JP); Satoshi Koura, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 713 days.

(21) Appl. No.: 09/816,000

(22) Filed: Mar. 23, 2001

(65) Prior Publication Data

US 2001/0043712 A1 Nov. 22, 2001

(30) Foreign Application Priority Data

Mar. 23, 2000 (JP) ..... 2000-081200
Jan. 11, 2001 (JP) ..... 2001-003305

(51) Int. Cl.[7] ..... H04R 25/00

(52) U.S. Cl. ..... 381/412; 381/420; 381/403; 381/405

(58) Field of Search ..... 381/396, 397, 381/403, 404, 412, 407, 420, 432, 405; 181/171, 172, 166

(56) References Cited

U.S. PATENT DOCUMENTS 5,081,684 A 1/1992 House
6,088,466 A * 7/2000 Proni ..... 381/397

FOREIGN PATENT DOCUMENTS

| | | |
|---|---|---|
| JP | 55-64500 | 5/1980 |
| JP | 56-027600 | 3/1981 |
| JP | 57-38079 | 8/1982 |
| JP | 01-126899 | 5/1989 |
| JP | 2000-278791 | 10/2000 |

OTHER PUBLICATIONS

European Search Report dated Nov. 1, 2002, Application No. EP 01106455.

* cited by examiner

*Primary Examiner*—Huyen Le
(74) *Attorney, Agent, or Firm*—RatnerPrestia

(57) ABSTRACT

A loudspeaker includes: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a first annular member for supporting the coil; a plurality of support members for supporting the first annular member, the plurality of support members being inserted into the plurality of slits; and a diaphragm supported by the plurality of support members, wherein upper faces of the plurality of support members gradually decrease in height in a direction away from the first annular member, and wherein a lower face of the coil is located below a position at which the diaphragm is supported by the plurality of support members.

62 Claims, 41 Drawing Sheets

LOUDSPEAKER

BACKGROUND OF THE INVENTION

1. Field of the Invention

The present invention relates to a thin loudspeaker having a relatively low profile.

2. Description of the Related Art

A loudspeaker structure is disclosed in Japanese Laid-Open Patent Publication No. 55-64500, which includes a yoke having slits formed therein, and support members inserted in the slits, such that a voice coil and a diaphragm are coupled via the support members.

FIG. 39 is a cross-sectional view illustrating a conventional loudspeaker 7000 disclosed in Japanese Laid-Open Patent Publication No. 55-64500. FIG. 40 is a plan view illustrating a magnetic circuit and associated elements, as viewed from above a diaphragm 8 of the loudspeaker 7000.

The loudspeaker 7000 includes: a bottom plate 23; a magnet 1 provided on the bottom plate 23; a center pole 2 provided on the magnetic 1; a yoke 3 which is provided so as to surround the center pole 2 and which has a plurality of slits 11 in a radial arrangement; a coupling member 37; a voice coil 39 affixed to the inner periphery of the coupling member 37; a diaphragm 8 and dampers 10 affixed to the outer periphery of the coupling member 37; frames 12A and 12B; and a cover 34. The coupling member 37 has support members 35 to be inserted in the plurality of slits 11, and inner and outer rings 36 and 46.

The magnet 1, the center pole 2, the yoke 3, and the bottom plate 23 together compose a magnetic circuit. A magnetic flux is generated within a magnetic gap 4 by the magnetic circuit.

As an electric input is supplied to the voice coil 39 in the above structure, a driving force along a vertical direction is generated in the voice coil 39 according to Fleming's left-hand rule, due to the magnetic flux generated within the magnetic gap 4. Since the diaphragm 8 is coupled to the voice coil 39 by means of the coupling member 37 (i.e., via the support members 35), the driving force generated in the voice coil 39 is transmitted to the diaphragm 8, which vibrates and emits sound. Since this structure prevents the diaphragm 8 from contacting an upper face 3A of the yoke 3, there is no need to allow for an amplitude margin when designing the total height of the loudspeaker 7000. As a result, the total height h can be reduced.

FIG. 41 is a plan view showing a cylindrical coupling member 47 disclosed in Japanese Laid-Open Patent Publication No. 55-64500, supra. The cylindrical coupling member 47 is composed of an elongated metal foil which is folded at periodic lengths, so that the folded portions are linked together to form protruding support members 45 of the cylindrical coupling member 47. A voice coil 39 is affixed to the inner periphery of the coupling member 47.

However, in accordance with the loudspeaker 7000 shown in FIGS. 39 and 40, it is necessary to attach the coupling member 37 to the outer periphery of the voice coil 39. As the wire diameter for the voice coil 39 is changed in order to obtain various levels of driving force, the outer diameter of the voice coil 39 also varies. This necessitates a change in the inner diameter of the inner periphery of the coupling member 37 to which the voice coil 39 is attached. In other words, for each voice coil 39, a coupling member 37 having corresponding geometry must be designed. This presents a problem, when mass producing various models, in that costs associated with the production of component parts and the production facility itself are increased, and that the storage and management of varying component parts becomes cumbersome.

On the other hand, in the case where the coupling member 47 with support members 45 as shown in FIG. 41 is formed by folding a thin metal foil (especially due to mass productivity-related concerns), the support members 45 can only be adhered to the diaphragm 8 and the dampers 10 in an extremely small adhesion area, resulting in a poor adhesion strength. Consequently, peeling associated with the diaphragm 8 moving with a large amplitude or failure of the driving force generated in the voice coil 39 to be transmitted to the diaphragm 8 may occur, thereby unfavorably affecting the sound pressure characteristics of the loudspeaker 7000.

SUMMARY OF THE INVENTION

According to the present invention, there is provided a loudspeaker including: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a first annular member for supporting the coil; a plurality of support members for supporting the first annular member, the plurality of support members being inserted into the plurality of slits; and a diaphragm supported by the plurality of support members, wherein upper faces of the plurality of support members gradually decrease in height in a direction away from the first annular member, and wherein a lower face of the coil is located below a position at which the diaphragm is supported by the plurality of support members.

In one embodiment of the invention, the lower face of the coil is located below lower faces of the plurality of support members.

In another embodiment of the invention, the coil is provided at an outer periphery of the first annular member.

In still another embodiment of the invention, the loudspeaker further includes a plurality of dampers for supporting the plurality of support members.

In still another embodiment of the invention, the plurality of support members each have a plate-like shape.

In still another embodiment of the invention, the loudspeaker further includes a second annular member provided between the plurality of support members and the first annular member, wherein the plurality of support members support the first annular member via the second annular member.

In still another embodiment of the invention, the plurality of support members and the first annular member are formed as an integral piece.

In still another embodiment of the invention, the plurality of support members and the second annular member are formed as an integral piece.

In still another embodiment of the invention, the loudspeaker further includes a third annular member provided between the plurality of support members and the diaphragm, wherein the plurality of support members support the diaphragm via the third annular member.

In still another embodiment of the invention, the loudspeaker further includes a third annular member provided between the plurality of support members and the plurality of dampers, wherein the plurality of dampers support the plurality of support members via the third annular member.

In still another embodiment of the invention, the plurality of support members and the third annular member are formed as an integral piece.

In still another embodiment of the invention, the loudspeaker further includes a second annular member provided between the plurality of support members and the first annular member, wherein the plurality of support members support the first annular member via the second annular member.

In still another embodiment of the invention, the magnet is provided between the bottom plate and the center pole.

In still another embodiment of the invention, the bottom plate and the yoke are formed as an integral piece.

In still another embodiment of the invention, the magnet surrounds the center pole.

In still another embodiment of the invention, the magnet has a plurality of slits; and the plurality of slits of the magnet are disposed so as to be aligned with the plurality of slits of the yoke.

In still another embodiment of the invention, the bottom plate and the center pole are formed as an integral piece.

In still another embodiment of the invention, the first annular member is supported at a first end of each of the plurality of support members, and the diaphragm is supported at a second end of each of the plurality of support members; and a lower face of each of the plurality of support members has a stepped configuration such that the lower face is lower at the second end than at the first end.

In still another embodiment of the invention, the loudspeaker further includes a cover provided so as to cover an upper face of the center pole.

In still another embodiment of the invention, the cover and the first annular member are formed as an integral piece.

Alternatively, a loudspeaker according to the present invention includes: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a first annular member for supporting the coil; a coupling member composed essentially of a plate material folded into an annular shape having a plurality of protruding portions, the coupling member supporting the first annular member, wherein one of the plurality of protruding portions is inserted into two of the plurality of slits; and a diaphragm supported by the coupling member.

In one embodiment of the invention, the loudspeaker further includes a plurality of dampers for supporting the coupling member.

In another embodiment of the invention, the loudspeaker further includes a cover provided so as to cover an upper face of the center pole.

In still another embodiment of the invention, the cover and the first annular member are formed as an integral piece.

Alternatively, a loudspeaker according to the present invention includes: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a coupling member composed essentially of a plate material folded into an annular shape having a plurality of protruding portions, the coupling member supporting the coil, wherein one of the plurality of protruding portions is inserted into two of the plurality of slits; and a diaphragm supported by the coupling member.

In still another embodiment of the invention, the loudspeaker further includes a plurality of dampers for supporting the coupling member.

Alternatively, a loudspeaker according to the present invention includes: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a first annular member for supporting the coil; a plurality of support members, each having a first end and a second end, for supporting the first annular member at the first ends, the plurality of support members being inserted into the plurality of slits; and a diaphragm supported by the plurality of support members at the second ends, wherein a lower face of each of the plurality of support members has a stepped configuration such that the lower face is lower at the second end than at the first end, and the diaphragm supported by the plurality of support members at the second ends is supported at a position below the lower face, at the first end, of each of the plurality of support members.

In one embodiment of the invention, the coil is provided at an outer periphery of the first annular member.

In another embodiment of the invention, the loudspeaker further includes a plurality of dampers for supporting the plurality of support members.

In still another embodiment of the invention, the loudspeaker further includes a second annular member provided between the plurality of support members and the first annular member, wherein the plurality of support members support the first annular member via the second annular member.

In still another embodiment of the invention, the plurality of support members and the first annular member are formed as an integral piece.

In still another embodiment of the invention, the plurality of support members and the second annular member are formed as an integral piece.

In still another embodiment of the invention, the loudspeaker further includes a third annular member provided between the plurality of support members and the diaphragm, wherein the plurality of support members support the diaphragm via the third annular member.

In still another embodiment of the invention, the loudspeaker further includes a third annular member provided between the plurality of support members and the plurality of dampers, wherein the plurality of dampers support the plurality of support members via the third annular member.

In still another embodiment of the invention, the plurality of support members and the third annular member are formed as an integral piece.

In still another embodiment of the invention, the loudspeaker further includes a second annular member provided between the plurality of support members and the first annular member, wherein the plurality of support members are interposed between the second annular member and the third annular member.

In still another embodiment of the invention, the magnet is provided between the bottom plate and the center pole.

In still another embodiment of the invention, the bottom plate and the yoke are formed as an integral piece.

In still another embodiment of the invention, the magnet surrounds the center pole.

In still another embodiment of the invention, the magnet has a plurality of slits; and the plurality of slits of the magnet are disposed so as to be aligned with the plurality of slits of the yoke.

In still another embodiment of the invention, the bottom plate and the center pole are formed as an integral piece.

In still another embodiment of the invention, the loudspeaker further includes a thin plate for interconnecting upper faces of at least two of the plurality of support members.

In still another embodiment of the invention, the second end of each of the plurality of support members has a height-wise dimension greater than a height-wise dimension of the first end of the support member.

In still another embodiment of the invention, the loudspeaker further includes a cover provided so as to cover an upper face of the center pole.

In still another embodiment of the invention, the cover and the first annular member are formed as an integral piece.

Alternatively, a loudspeaker according to the present invention includes: a bottom plate; a center pole provided upwardly from the bottom plate; a yoke surrounding the center pole and having a plurality of slits; a magnet for providing a magnetic flux for the center pole and the yoke; a coil provided between the center pole and the yoke; a first annular member for supporting the coil; a plurality of support members for supporting the first annular member, the plurality of support members being inserted into the plurality of slits; a diaphragm supported by the plurality of support members; and a second annular member provided between the plurality of support members and the diaphragm, wherein the plurality of support members support the diaphragm via the second annular member, and wherein a plurality of thin plates for reinforcing the second annular member are provided at at least one of an inner periphery and an outer periphery of the second annular member.

In one embodiment of the invention, each of the plurality of support members has a constant dimension in a direction of vibration of the diaphragm.

In another embodiment of the invention, the second annular member and the plurality of thin plates are formed as an integral piece.

In still another embodiment of the invention, the loudspeaker further includes a third annular member provided between the plurality of support members and the first annular member, wherein the plurality of support members are interposed between the second annular member and the third annular member.

In still another embodiment of the invention, the loudspeaker further includes a thin plate for interconnecting upper faces of at least two of the plurality of support members.

In still another embodiment of the invention, the first annular member is supported at a first end of each of the plurality of support members, and the diaphragm is supported at a second end of each of the plurality of support members; and a lower face of each of the plurality of support members has a stepped configuration such that the lower face is lower at the second end than at the first end.

In still another embodiment of the invention, the second end of each of the plurality of support members has a height-wise dimension greater than a height-wise dimension of the first end of the support member.

In still another embodiment of the invention, the plurality of thin plates are provided at an outer periphery of the second annular member; the number of thin plates is equal to the number of support members; and the plurality of thin plates are positioned on extensions of the plurality of support members along a radial direction of the first annular member.

In still another embodiment of the invention, the plurality of thin plates are provided at an inner periphery of the second annular member; and at least one of the plurality of thin plates is provided in closer proximity to one of the plurality of support members than to others of the plurality of thin plates.

In still another embodiment of the invention, a lower face of the coil is located below lower faces of the plurality of support members.

In still another embodiment of the invention, the coil is provided at an outer periphery of the first annular member.

In still another embodiment of the invention, the loudspeaker further includes a cover provided so as to cover an upper face of the center pole.

In still another embodiment of the invention, the cover and the first annular member are formed as an integral piece.

Thus, the invention described herein makes possible the advantage of providing a loudspeaker incorporating a coupling member having a small mass and high mechanical strength, which can reduce the production cost associated with the mass production of various models and which can provide a sufficient vibration amplitude.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples, with reference to FIGS. 1 to 38. Like numerals denote like components throughout the description of such examples.

EXAMPLE 1

Figure 1:
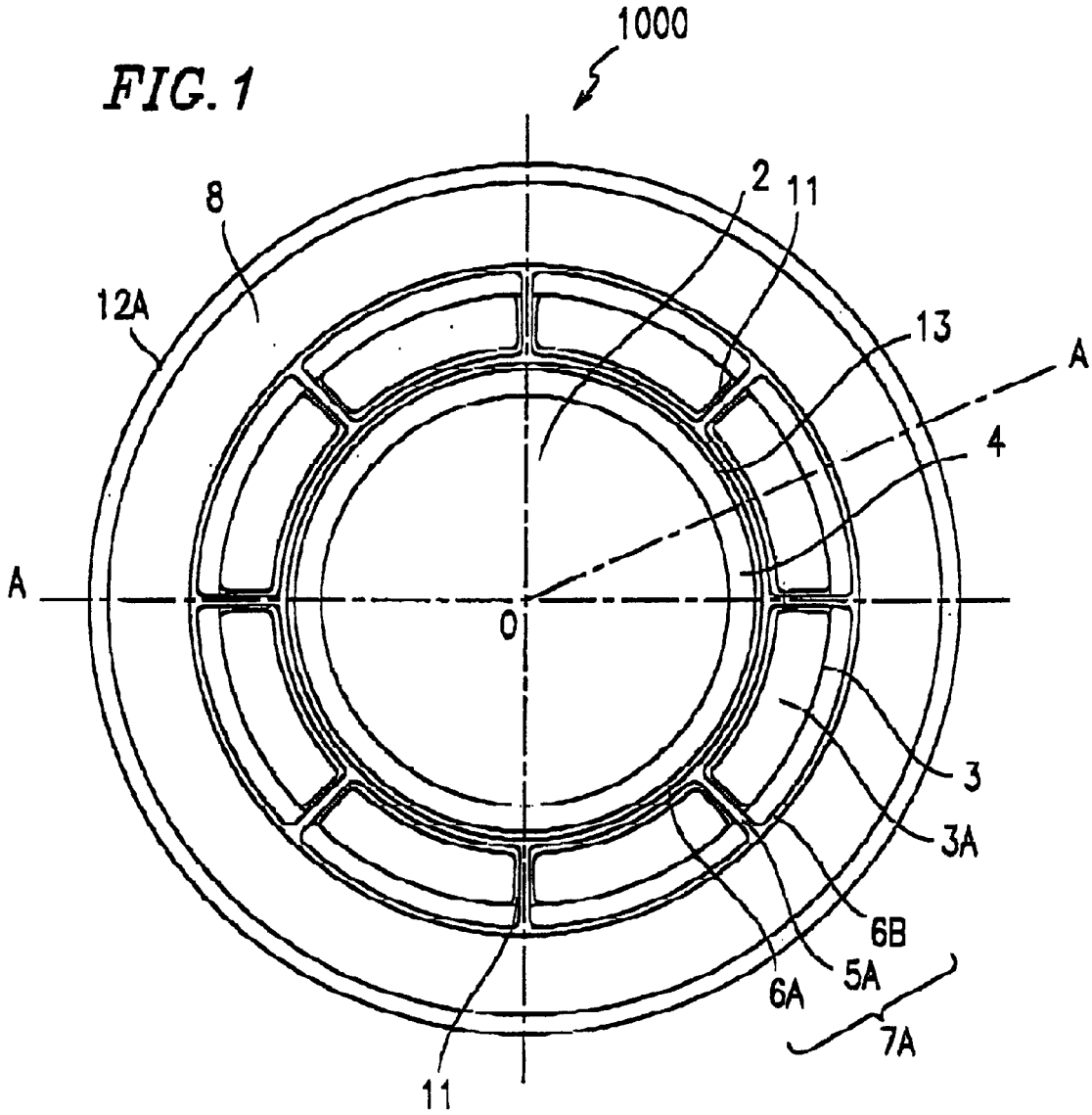
FIG. 1 is a plan view illustrating a loudspeaker according to Example 1 of the present invention.

FIG. 1 is a plan view illustrating a loudspeaker 1000 according to Example 1 of the present invention.

Figure 2:
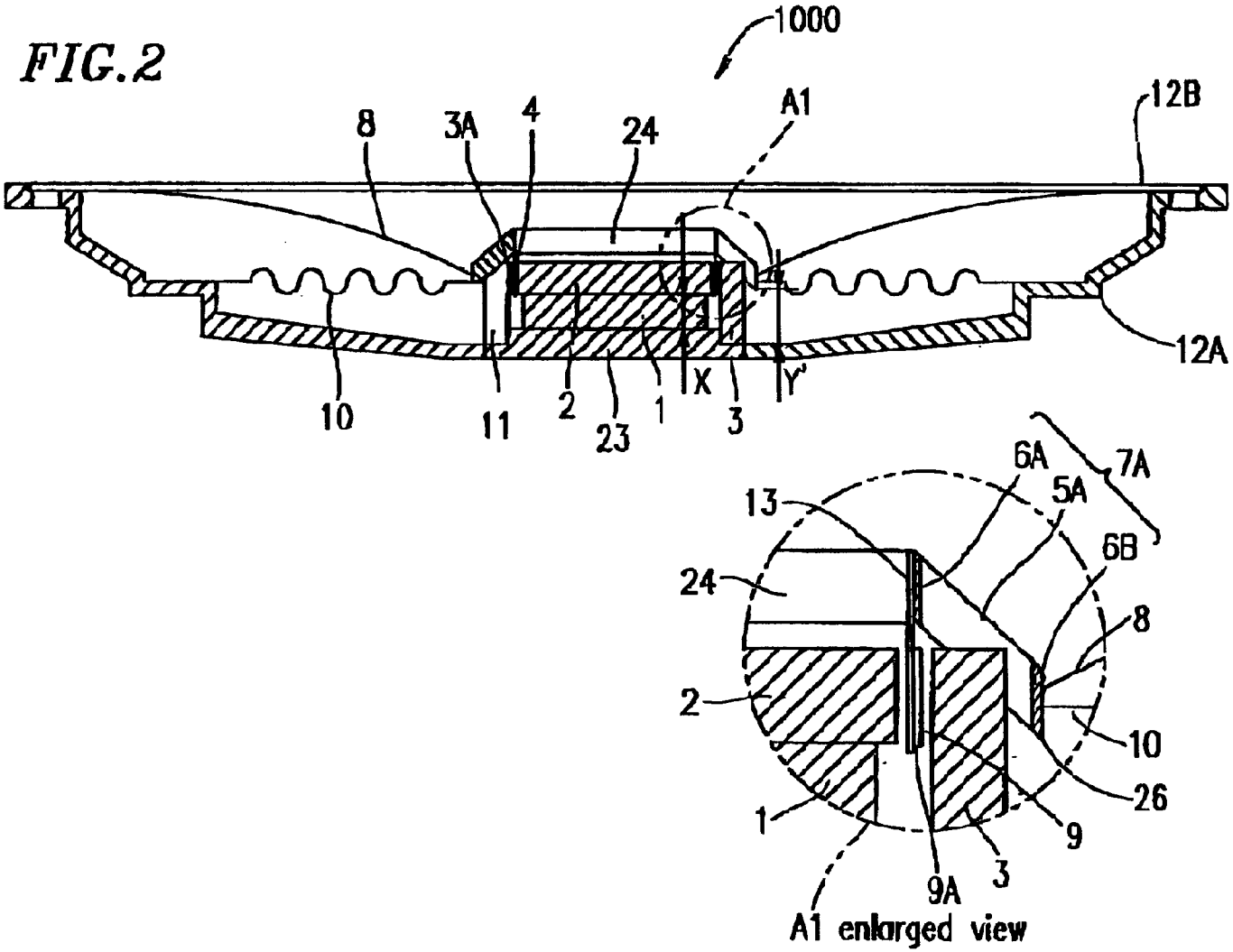
FIG. 2 is a cross-sectional view illustrating a loudspeaker according to Example 1 of the present invention.

FIG. 2 is a cross-sectional view illustrating the loudspeaker 1000, taken at line A-O-A in FIG. 1.

Referring to FIGS. 1 and 2, the loudspeaker 1000 includes: a bottom plate 23; a magnet 1 provided on the bottom plate 23; a center pole 2 provided on the magnetic 1; a yoke 3 which is provided so as to surround the center pole 2 and which has a plurality of slits 11 in a radial arrangement; a coupling member 7A; an annular voice coil bobbin 13 affixed to the inner periphery of the coupling member 7A; a voice coil 9 wound around a lower portion of the voice coil bobbin 13; a diaphragm 8 and dampers 10 affixed to the outer periphery of the coupling member 7A; frames 12A and 12B; and a cover 24.

The coupling member 7A has support members 5A to be inserted in the plurality of slits 11, and inner and outer annular members 6A and 6B. The support members 5A are interposed between the inner and outer annular members 6A and 6B. The voice coil bobbin 13 is affixed to the inner annular member 6A, whereas the diaphragm 8 and the dampers 10 are affixed to the outer annular member 6B. Each support member 5A has a cross section which obliquely descends from a central portion of the loudspeaker 1000 toward the outer periphery. A bottom face 9A of the voice coil 9 is located below the lower most face of the coupling member 7A (e.g., a bottom face 26 of the outer annular member 6B). The bottom face 9A of the voice coil 9 is located below a junction portion (on the outer annular member 6B) between each support member 5A and the diaphragm 8.

In any of the plan views employed for the illustration of specific examples of the present invention, one or more component elements (e.g., the cover 24) may conveniently be omitted for clarity.

Now, the operation of the above-described structure will be described.

The magnet 1, the yoke 3 having the radial arrangement of slits 11, the center pole 2, and the bottom plate 23 together compose a magnetic circuit. A magnetic flux is generated within a magnetic gap 4 by the magnetic circuit.

As an electric input is supplied to the voice coil 9 in the above structure, a driving force is generated in the voice coil 9 which is inserted within the magnetic gap 4 according to Fleming's left-hand rule, causing the voice coil 9 to vibrate along a vertical direction. Since the voice coil 9 is coupled to the diaphragm 8 by means of the voice coil bobbin 13 and the coupling member 7A (i.e., via the support members 5A), the driving force generated in the voice coil 9 is transmitted to the diaphragm 8. Thus, the diaphragm 8 is vibrated along the vertical direction with an amplitude in proportion to the electrical input to the voice coil 9, thereby emitting sound.

Since this structure prevents the diaphragm 8 from contacting an upper face 3A of the yoke 3, there is no need to allow for an amplitude margin when designing the total height of the loudspeaker 1000. As a result, the total height of the loudspeaker 1000 can be reduced.

In the case where the cover 24 is affixed to the voice coil bobbin 13, the cover 24 vibrates along the vertical direction as the voice coil 9 vibrates along the vertical direction. Alternatively, the cover 24 and the voice coil bobbin 13 may be detached from each other.

The voice coil 9 is wound around the outer periphery of the voice coil bobbin 13. Therefore, even if the wire diameter for the voice coil 9 is changed, thereby also changing the outer diameter of the voice coil 9, the voice coil bobbin 13 always has a constant outer diameter. Therefore, there is no need to change the inner diameter of the inner annular member 6A, which is affixed to the outer periphery of the voice coil bobbin 13. Thus, a single type of coupling member 7A can always be used for various types of voice coils 9 having different wire diameters for obtaining different levels of driving force. When mass producing various models, this presents the advantages of lower cost and ease of storage and management of component parts. It is also possible to employ a single type of voice coil bobbin 13 for various types of voice coils 9.

Although FIG. 2 illustrates an example in which the yoke 3 and the bottom plate 23 are composed of discrete elements, the yoke 3 and the bottom plate 23 may be formed as an integral piece.

The cover 24 for dust prevention purposes and the voice coil bobbin 13 may also be formed as an integral piece.

As mentioned above, the bottom face 9A of the voice coil 9 is located below the bottom face 26 of the outer annular member 6B. Therefore, as far as the vibration along the vertical direction is concerned, an amplitude margin Y' between the bottom face 26 of the outer annular member 6B and the frame 12A is equal to or greater than an amplitude margin X between the bottom face 9A of the voice coil 9 and the bottom plate 23. Therefore, only the amplitude margin X between the bottom face 9A of the voice coil 9 and the bottom plate 23 needs to be considered when designing an amplitude margin for the loudspeaker 1000. Thus, the design process can be facilitated, and defects associated with the collision between the bottom face 26 of the outer annular member 6B and the frame 12A can be minimized even when the loudspeaker 1000 is mass produced.

Moreover, the bottom face 9A of the voice coil 9 is located below a junction portion (on the outer annular member 6B) between each support member 5A and the diaphragm 8, where the diaphragm 8 is supported by the support members 5A. This allows the overall height of the coupling member 7A to be reduced, which in turn leads to a reduced mass of the coupling member 7A, whereby the vibration performance of the loudspeaker 1000 is enhanced. Especially, the overall height of the coupling member 7A can be effectively reduced if the bottom face 26 of the outer annular member 6B is located above the bottom face 9A of the voice coil 9, as opposed to if the bottom face 26 of the outer annular member 6B is located below the bottom face 9A of the voice coil 9. Again, this will lead to a reduced mass of the coupling member 7A, whereby the vibration performance of the loudspeaker 1000 can be enhanced.

The loudspeaker 1000 shown in FIG. 2 is an internal type magnetic circuit, i.e., the magnet 1 is positioned inside the yoke 3. Alternatively, as in a loudspeaker 1001 shown in FIG. 7, a magnet 1' may be provided around the outer periphery of a center pole 2', and a plurality of slits 11' may be provided in both a magnet 1' and a yoke 3' to compose an external type magnetic circuit. The center pole 2' and the bottom plate 23' may be formed as an integral piece. Reference numeral 3A' denotes an upper face of the yoke 3'.

Figure 3:
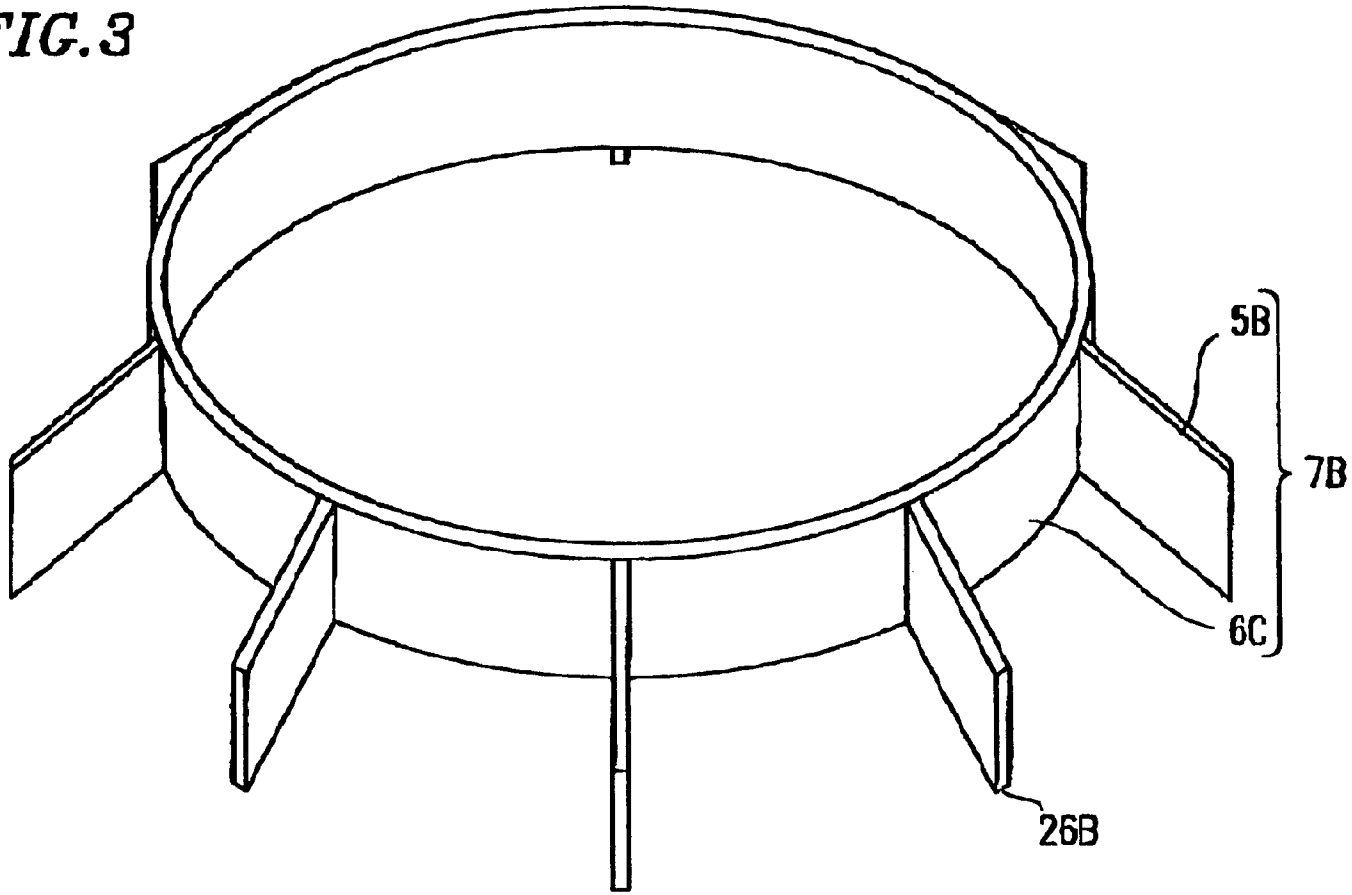
FIG. 3 is a perspective view illustrating a variant of support members and a coupling member according to Example 1 of the present invention.
Figure 4:
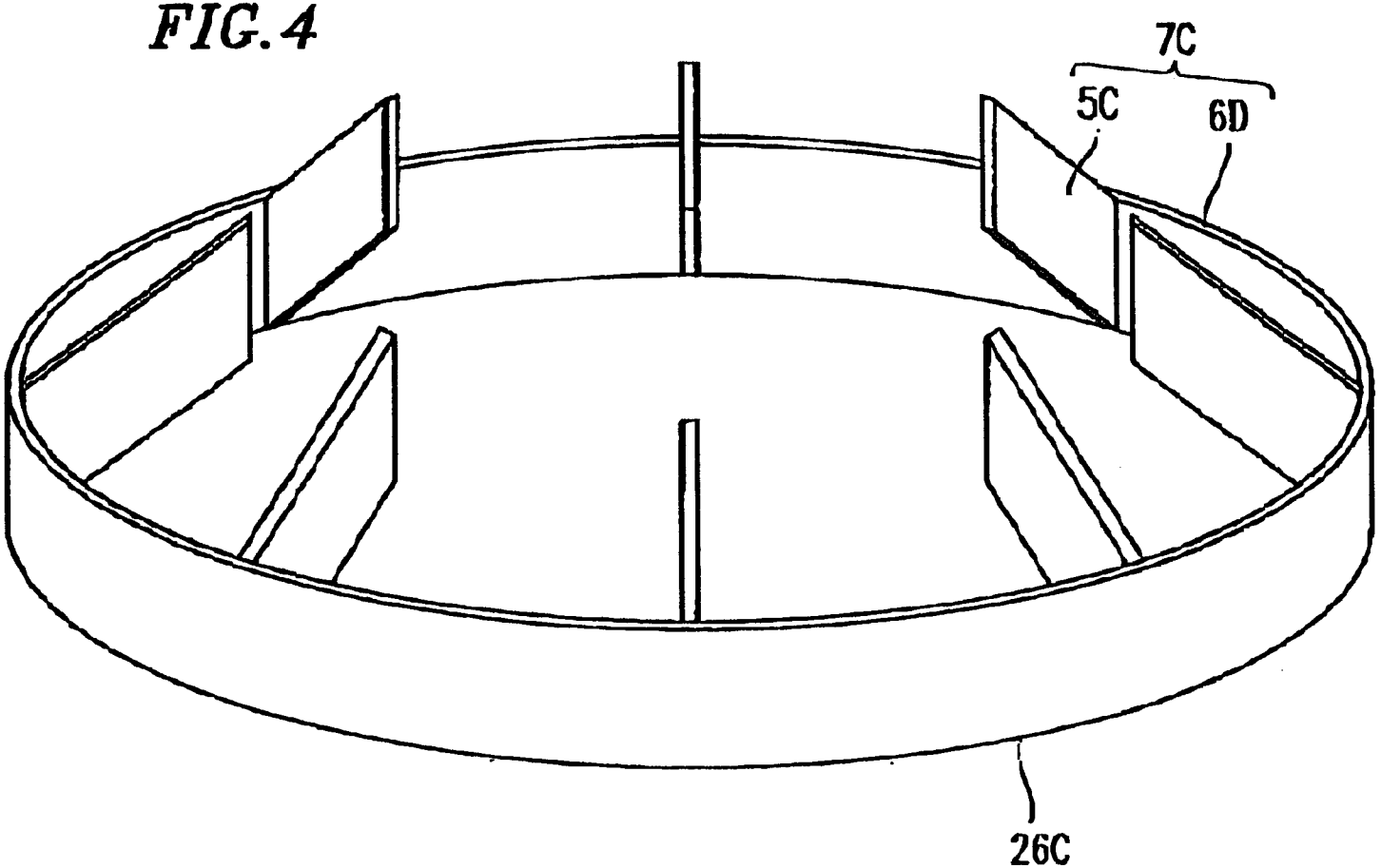
FIG. 4 is a perspective view illustrating a variant of support members and a coupling member according to Example 1 of the present invention.
Figure 5:
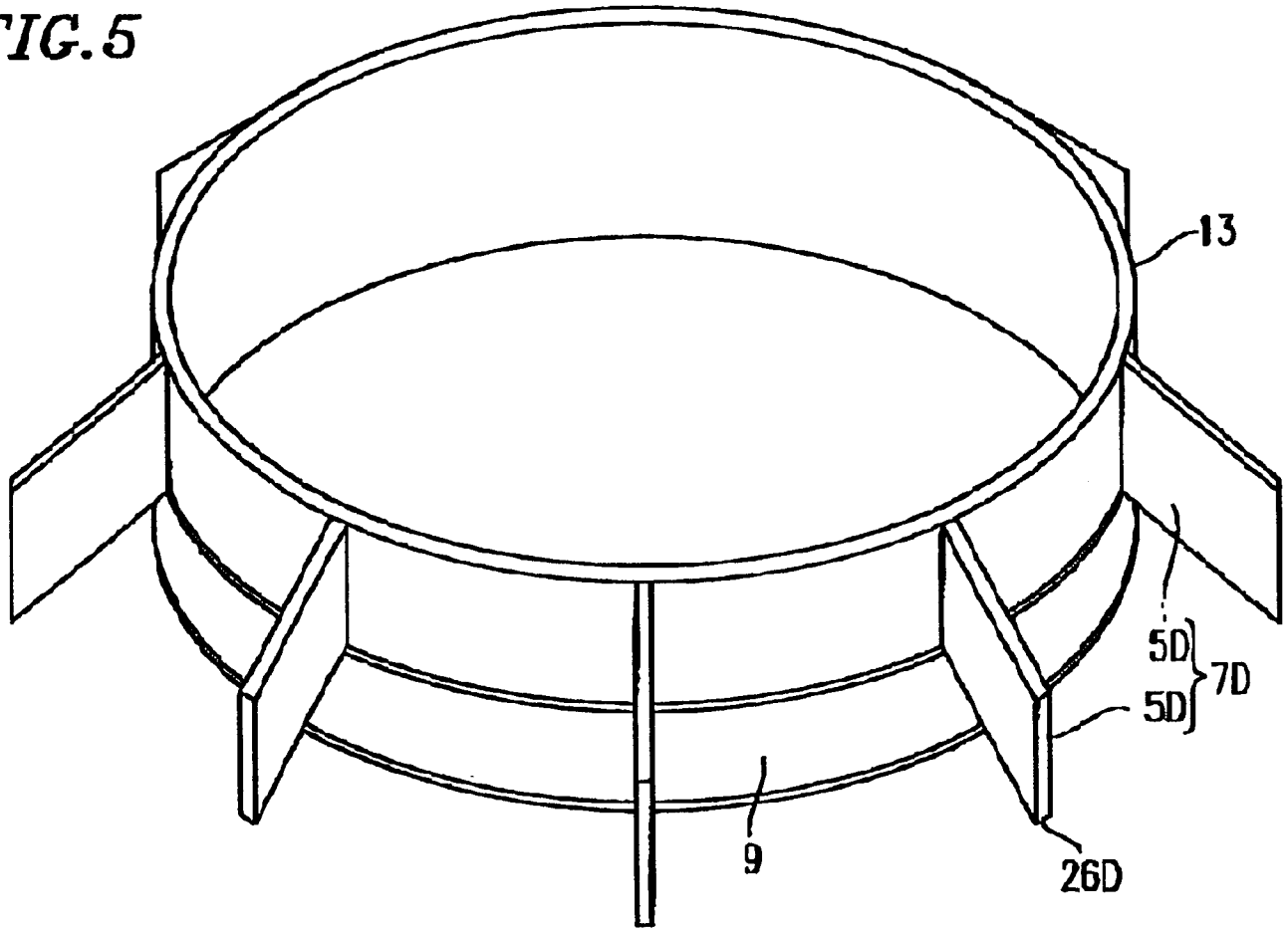
FIG. 5 is a perspective view illustrating a variant according to Example 1 of the present invention including support members directly coupled to a voice coil, in which annular members are omitted.

FIGS. 3, 4, and 5 are perspective views showing variants (7B, 7C, and 7D) of the coupling member 7A having support members 5A according to Example 1 of the present invention.

The coupling member 7B shown in FIG. 3 includes a plurality of support members 5B affixed to the outer periphery of one annular member 6C. The bottom face 9A of the voice coil 9 is located below bottom faces 26B of the support members 5B.

The coupling member 7C shown in FIG. 4 includes a plurality of support members 5C affixed to the inner periphery of one annular member 6D. The bottom face 9A of the voice coil 9 is located below bottom faces 26C of the annular member 6D.

The coupling member 7D shown in FIG. 5 includes a plurality of support members 5D, while omitting annular member 6A or 6B. The support members 5D directly support the voice coil bobbin 13. The bottom face 9A of the voice coil 9 is located below bottom faces 26D of the support members 5D.

The coupling members 7B, 7C, or 7D may replace the coupling member 7A in the present example of the present invention.

The coupling members 7B, 7C, and 7D contribute to a reduced vibrating system mass as compared to that realized with the coupling member 7A having two annular members 6A and 6B shown in FIG. 1, whereby the vibration performance of the loudspeaker 1000 can be enhanced. In addition, when the coupling member 7A having two annular members 6A and 6B shown in FIG. 1 is produced by using a mold, it may be difficult to pour a metal or resin material into the mold, or there may be some pressing problems, making the molding process difficult. In comparison, the coupling members 7B, 7C, and 7D would be relatively easy to mold, and therefore may be more advantageous for mass production.

Figure 6:
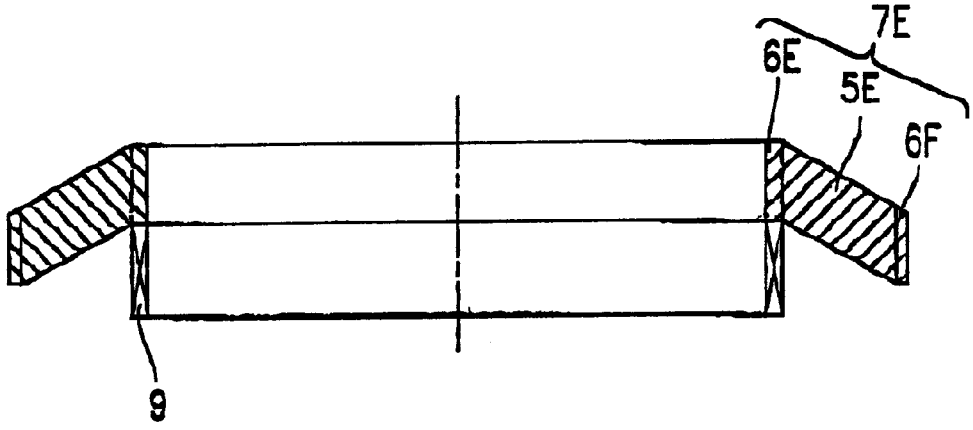
FIG. 6 is a cross-sectional view illustrating an alternative method for affixing a voice coil to a coupling member according to Example 1 of the present invention.
Figure 7:
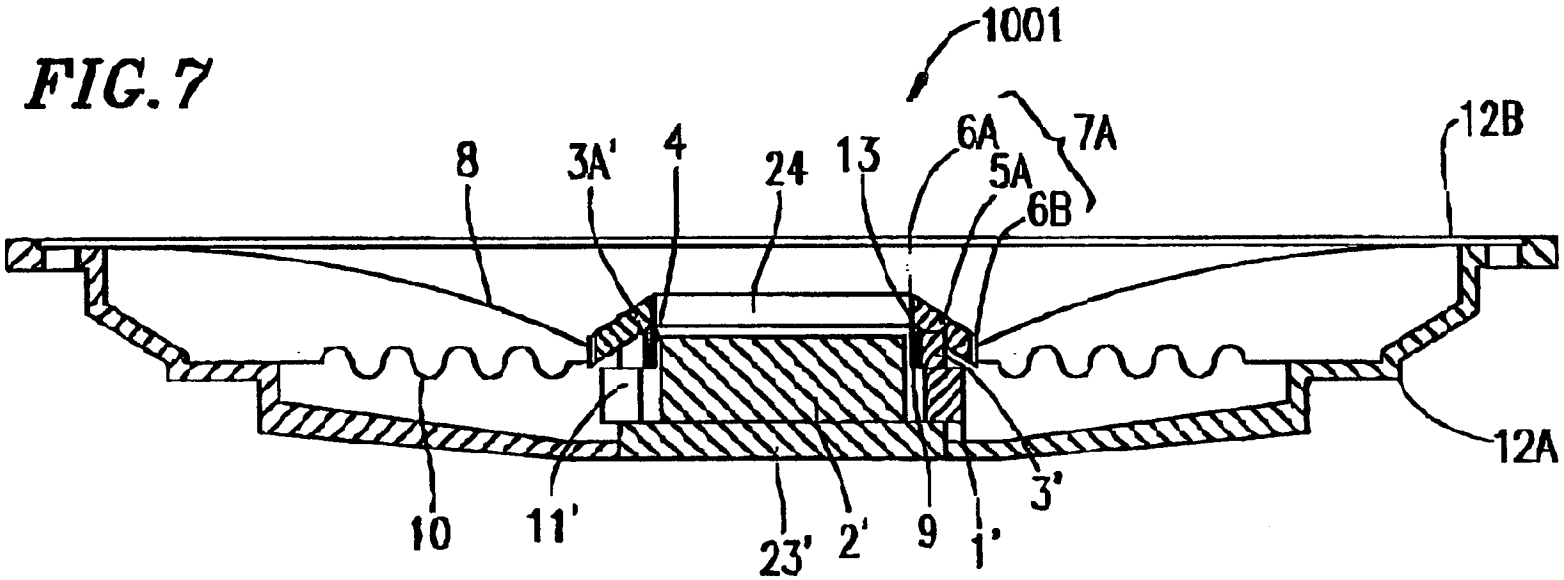
FIG. 7 is a cross-sectional view illustrating a loudspeaker according to Example 1 of the present invention incorporating an external type magnetic circuit.

FIG. 6 is a cross-sectional view illustrating a method for affixing the voice coil 9 to a coupling member 7E according to Example 1 of the present invention. The coupling member 7E, which may replace the aforementioned coupling member 7A, includes support members 5E and inner and outer annular members 6E and 6F. Whereas the voice coil 9 is provided at the inner periphery of the inner annular member 6A via the voice coil bobbin 13 in the structure shown in FIG. 2, the voice coil bobbin 13 is omitted in the structure shown in FIG. 6, so that the voice coil 9 is affixed to a lower portion of the inner annular member 6E. Thus, the mass of the vibrating system is reduced, and the magnetic gap 4 can be made narrow, whereby the vibration performance of the loudspeaker 1000 can be enhanced.

Figure 8:
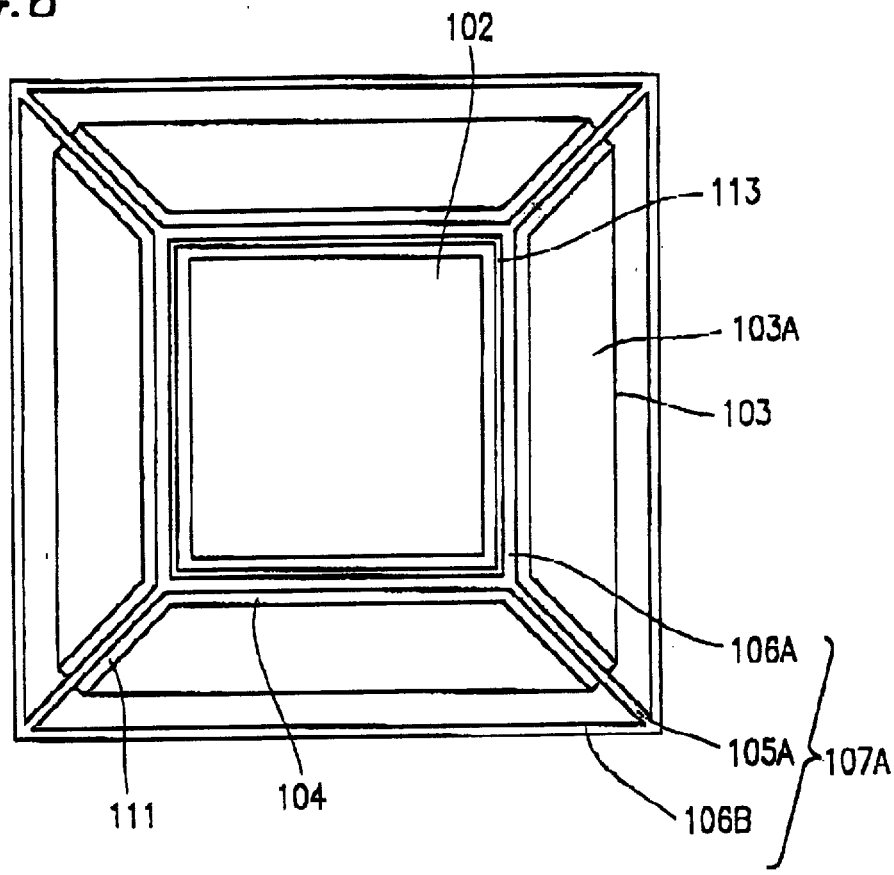
FIG. 8 is a plan view illustrating another configuration of the magnetic circuit according to the Example 1 of the present invention.

As shown in a plan view of FIG. 8, the loudspeaker 1000 may have a magnetic circuit which is configured in a polygonal shape. In this case, the center pole 2 of the loudspeaker 1000 is replaced by a center pole 102; the voice coil bobbin 13 is replaced by a voice coil bobbin 113; the inner and outer annular members 6A and 6B and support members 5A composing the coupling member 7A are replaced by inner and outer annular members 106A and 106B and support members 105A composing a coupling member 107A; and the yoke 3 is replaced by a yoke 103. The yoke 103 has slits 111 formed therein. Thus, a polygonal magnetic gap 104 is formed in the structure shown in FIG. 8. Reference numeral 103A denotes an upper face of the yoke 103. The loudspeaker 1000 may be formed in any configuration that allows for easy production. As used herein, the term "annular" is broadly defined to encompass such polygonal shapes.

EXAMPLE 2

Figure 9:
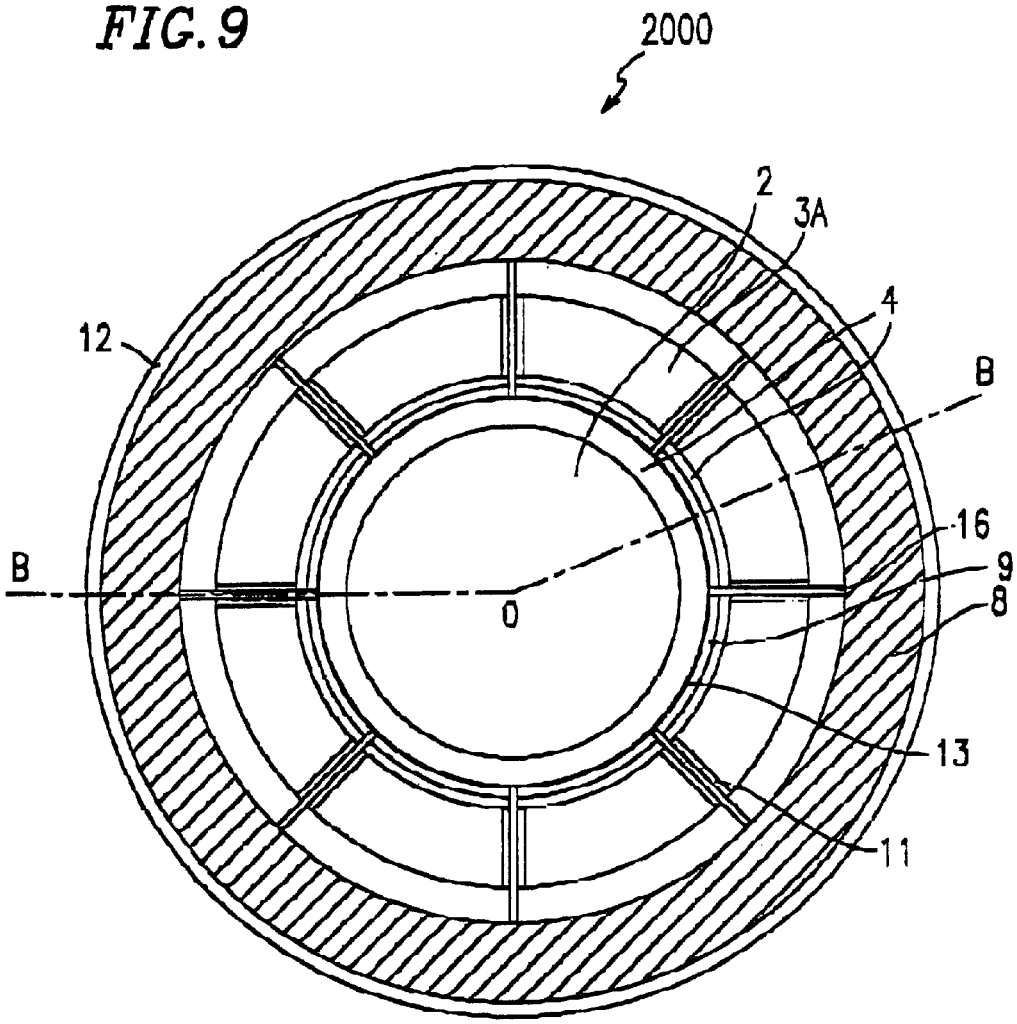
FIG. 9 is a plan view illustrating a loudspeaker according to Example 2 of the present invention.
Figure 10:
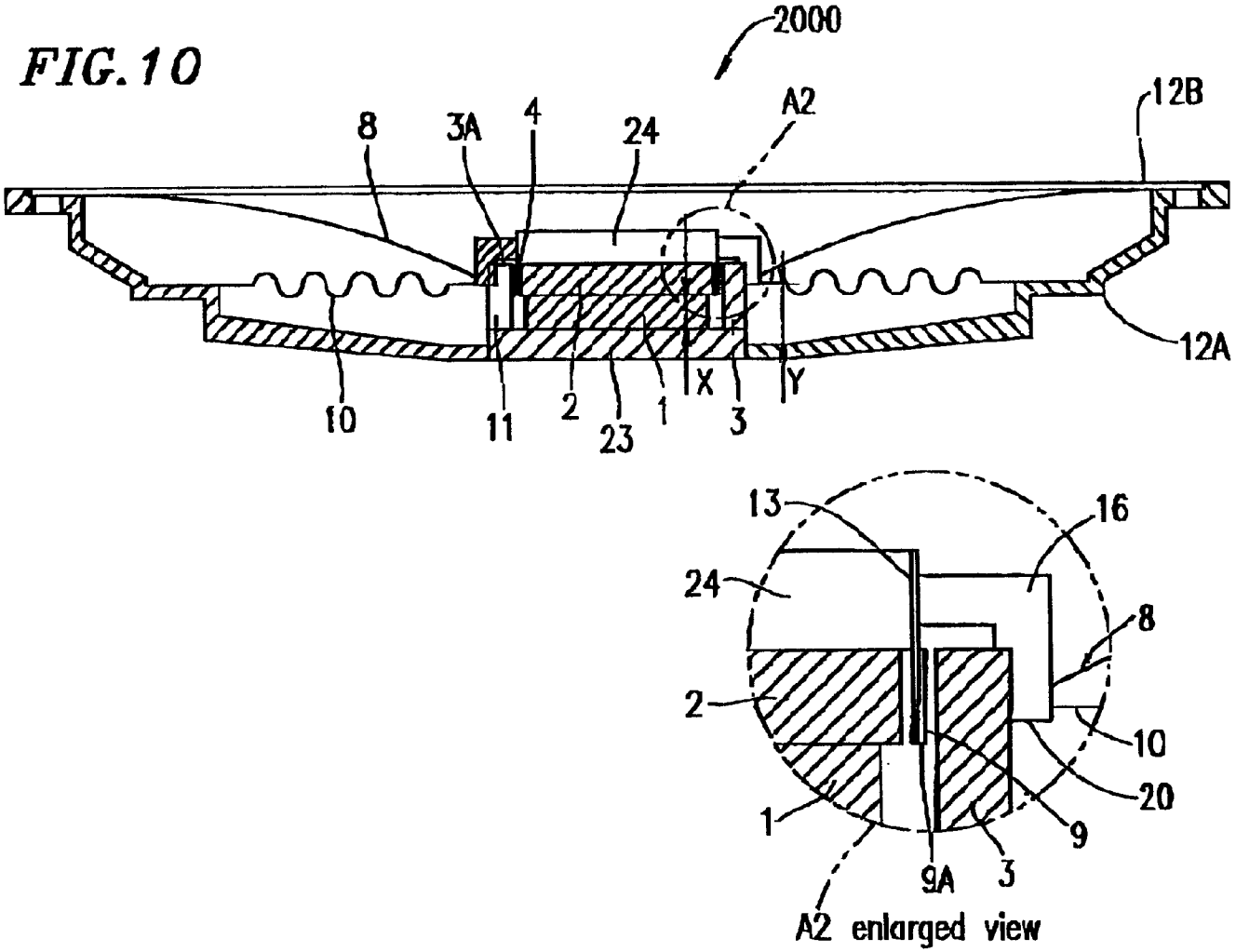
FIG. 10 is a cross-sectional view illustrating a loudspeaker according to Example 2 of the present invention.
Figure 11:
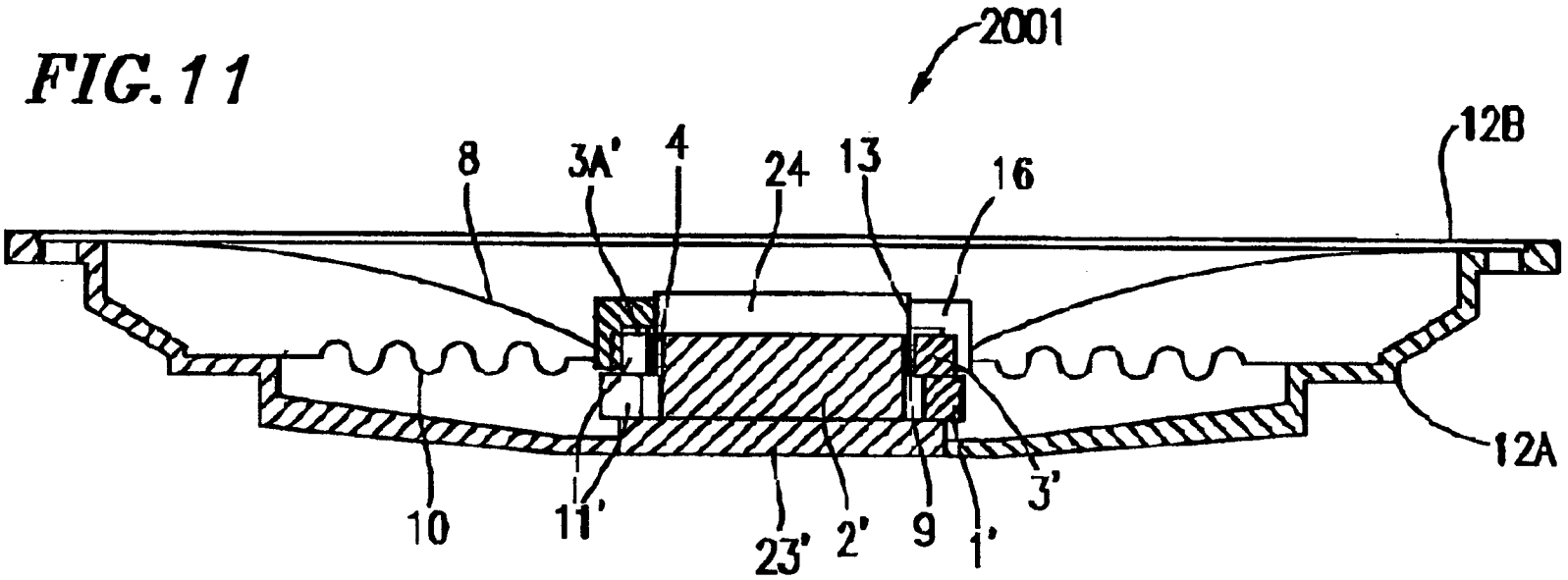
FIG. 11 is a cross-sectional view illustrating a loudspeaker according to Example 2 of the present invention incorporating an external type magnetic circuit.

FIG. 9 is a plan view illustrating a loudspeaker 2000 according to Example 2 of the present invention. FIG. 10 is a cross-sectional view illustrating the loudspeaker 2000, taken at line B-O-B in FIG. 9.

The loudspeaker 2000 includes support members 16 having a double-stepped shape. The support members 16 are inserted into slits 11 provided in a yoke 3. A voice coil bobbin 13, a diaphragm 8, and dampers 10 are directly affixed to the support members 16. The loudspeaker 2000 lacks inner and outer annular members 6A and 6B in the loudspeaker 1000 shown in FIGS. 1 and 2; otherwise, the loudspeaker 2000 has the same structure as that of the loudspeaker 1000.

In accordance with the loudspeaker 2000, a bottom face 9A of the voice coil 9 is located below a bottom face 20 of each support member 16.

Now, the operation of the above-described structure will be described.

The magnet 1, the yoke 3, a center pole 2, and a bottom plate 23 together compose a magnetic circuit. A magnetic flux is generated within a magnetic gap 4 by the magnetic circuit. As an electric input is supplied to the voice coil 9, a driving force is generated in the voice coil 9 according to Fleming's left-hand rule, causing the voice coil 9 to vibrate along a vertical direction. The driving force generated in the voice coil 9 is transmitted to the voice coil bobbin 13, the support members 16, and to the diaphragm 8. The diaphragm 8 is vibrated along the vertical direction with an amplitude in proportion to the electrical input to the voice coil 9, thereby emitting sound.

The effects provided by this structure will be described.

The voice coil 9 is wound around the outer periphery of the voice coil bobbin 13, as is the case with Example 1. Therefore, even if the wire diameter for the voice coil 9 is changed for loudspeaker characteristics adjustment, thereby also changing the outer diameter of the voice coil 9, the voice coil bobbin 13 always has a constant outer diameter. Therefore, there is no need to change the size of the support members 16, which are affixed to the outer periphery of the voice coil bobbin 13. Thus, a single type of support member 16 can always be used for various types of voice coils 9 having different wire diameters for changing the loudspeaker characteristics during production. When mass producing various models, this presents the advantages of lower cost and ease of storage and management of component parts. It is also possible to employ a single type of voice coil bobbin 13 for voice coils 9 of various wire diameters.

Figure 39:
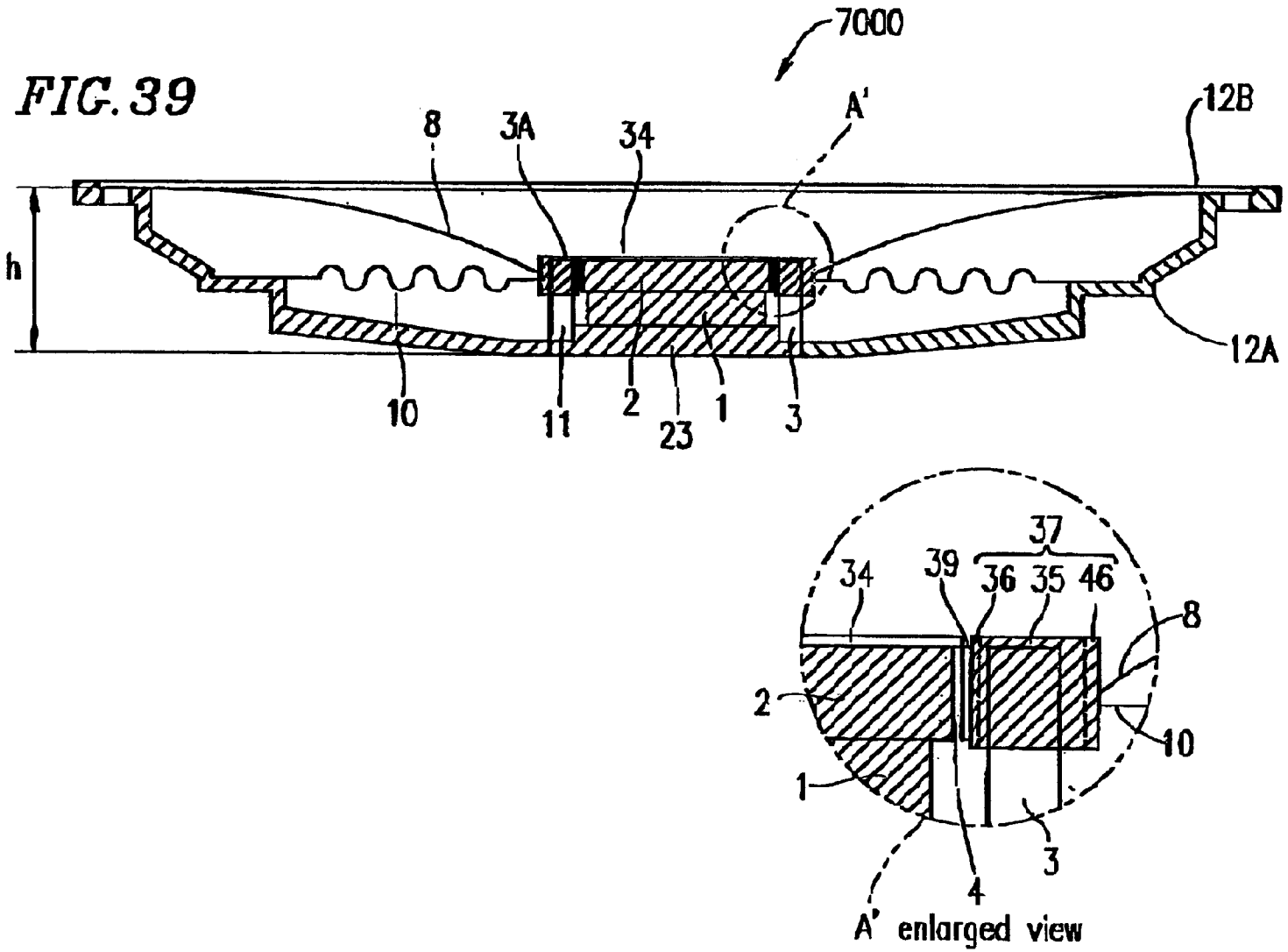
FIG. 39 is a cross-sectional view illustrating a conventional loudspeaker.
Figure 40:
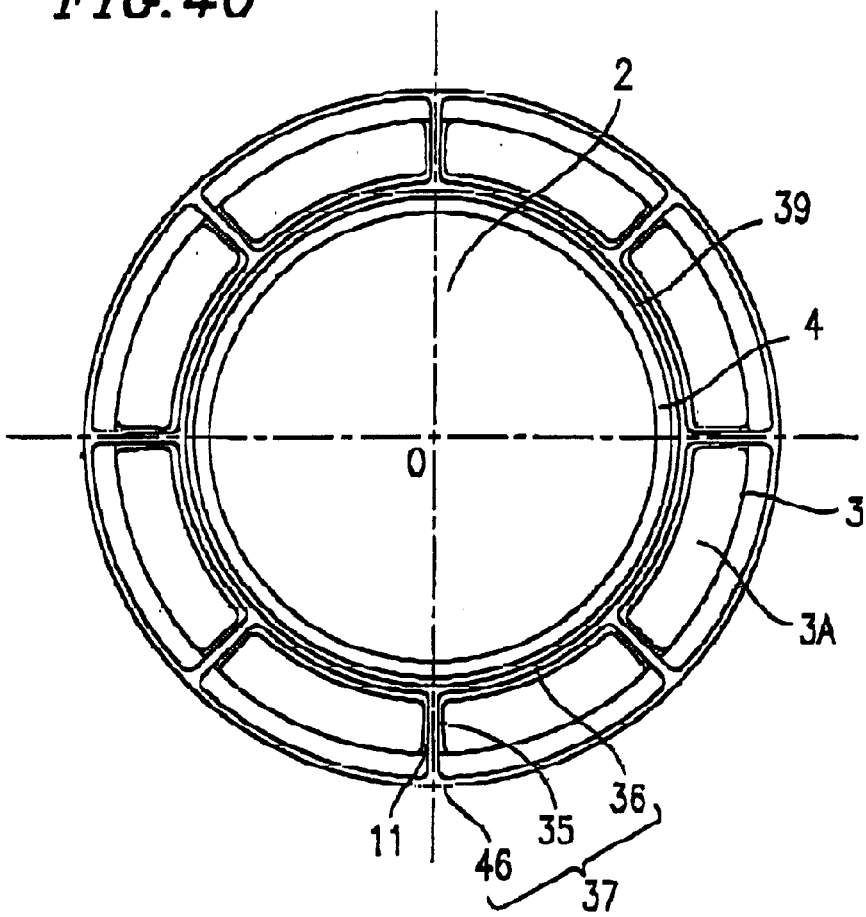
FIG. 40 is a plan view illustrating a conventional loudspeaker in the neighborhood of a magnetic circuit.
Figure 41:
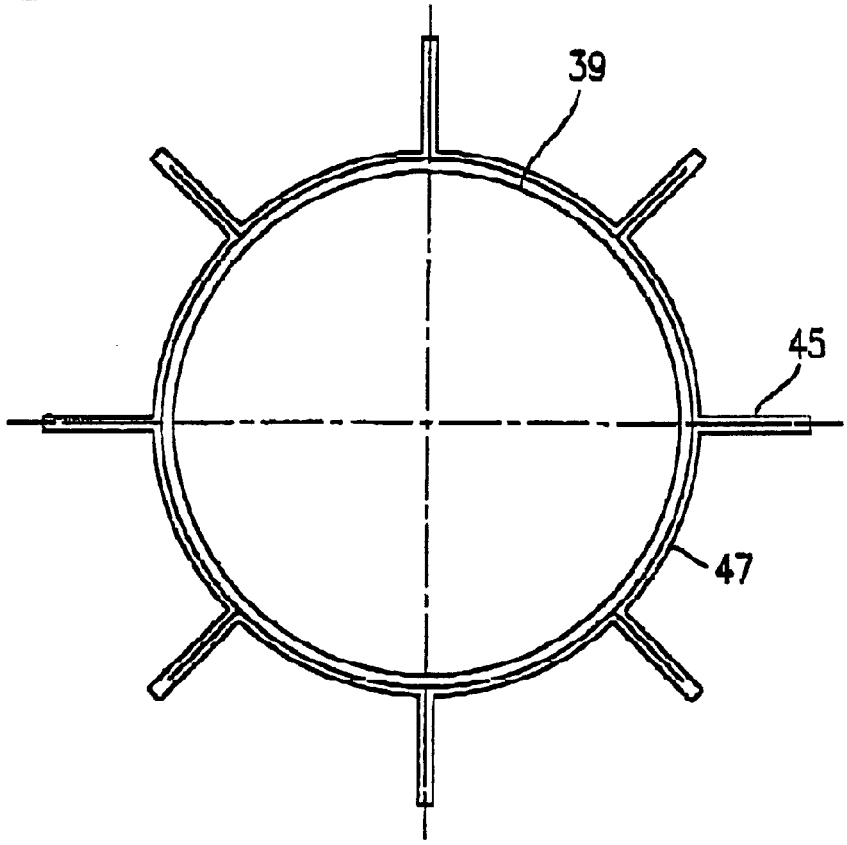
FIG. 41 is a plan view illustrating conventional support members formed by folding a thin metal plate (plate material).

In contrast, in accordance with the conventional loudspeaker 7000 shown in FIGS. 39 and 40, the coupling member 37 are affixed to the outer periphery of the voice coil 39. Therefore, as the outer diameter of the voice coil 39 changes, it is necessary to change the inner diameter of the coupling member 37 (i.e., the inner diameter of the ring 36) to which the voice coil 39 is attached. In other words, each coupling member 37 can only be adapted to a voice coil 39 of a given wire diameter.

Since the support members 16 have a double-stepped shape, a junction portion between each support member 16 and the diaphragm 8 can be located close to the plane on which the voice coil 9 is located. Thus, the overall height of the loudspeaker 2000 can be reduced.

As shown in FIG. 10, the bottom face 9A of the voice coil 9 is located below the bottom faces 20 of the support members 16. Therefore, as far as the vibration along the vertical direction is concerned, an amplitude margin Y between the bottom faces 20 of the support members 16 and the frame 12A is equal to or greater than an amplitude margin X between the bottom face 9A of the voice coil 9 and the bottom plate 23. Therefore, only the amplitude margin X between the bottom face 9A of the voice coil 9 and the bottom plate 23 needs to be considered when designing an amplitude margin for the loudspeaker 2000. Thus, the design process can be facilitated, and defects associated with the collision between the bottom faces 20 of the support members 16 and the frame 12A can be minimized even when the loudspeaker 2000 is mass produced.

Especially, the overall height of the support members 16 can be effectively reduced if the bottom faces 20 of the support members 16 are located above the bottom face 9A of the voice coil 9 (as shown in FIG. 10), as opposed to if the bottom faces 20 of the support members 16 are located below the bottom face 9A of the voice coil 9. Again, this will lead to a reduced mass of the support members 16, whereby the vibration performance of the loudspeaker 2000 can be enhanced.

The loudspeaker 2000 shown in FIG. 10 is an internal type magnetic circuit, i.e., the magnet 1 is affixed to a lower portion of the center pole 2. Alternatively, as in a loudspeaker 2001 shown in FIG. 11, a magnet 1' may be provided around the outer periphery of a center pole 2', and a plurality of slits 11' may be provided in both a magnet 1' and a yoke 3' to compose an external type magnetic circuit. The center pole 2' and the bottom plate 23' may be formed as an integral piece.

Although the illustrated support members 16 have a double-stepped shape, they may alternatively have three or more steps.

EXAMPLE 3

Figure 12:
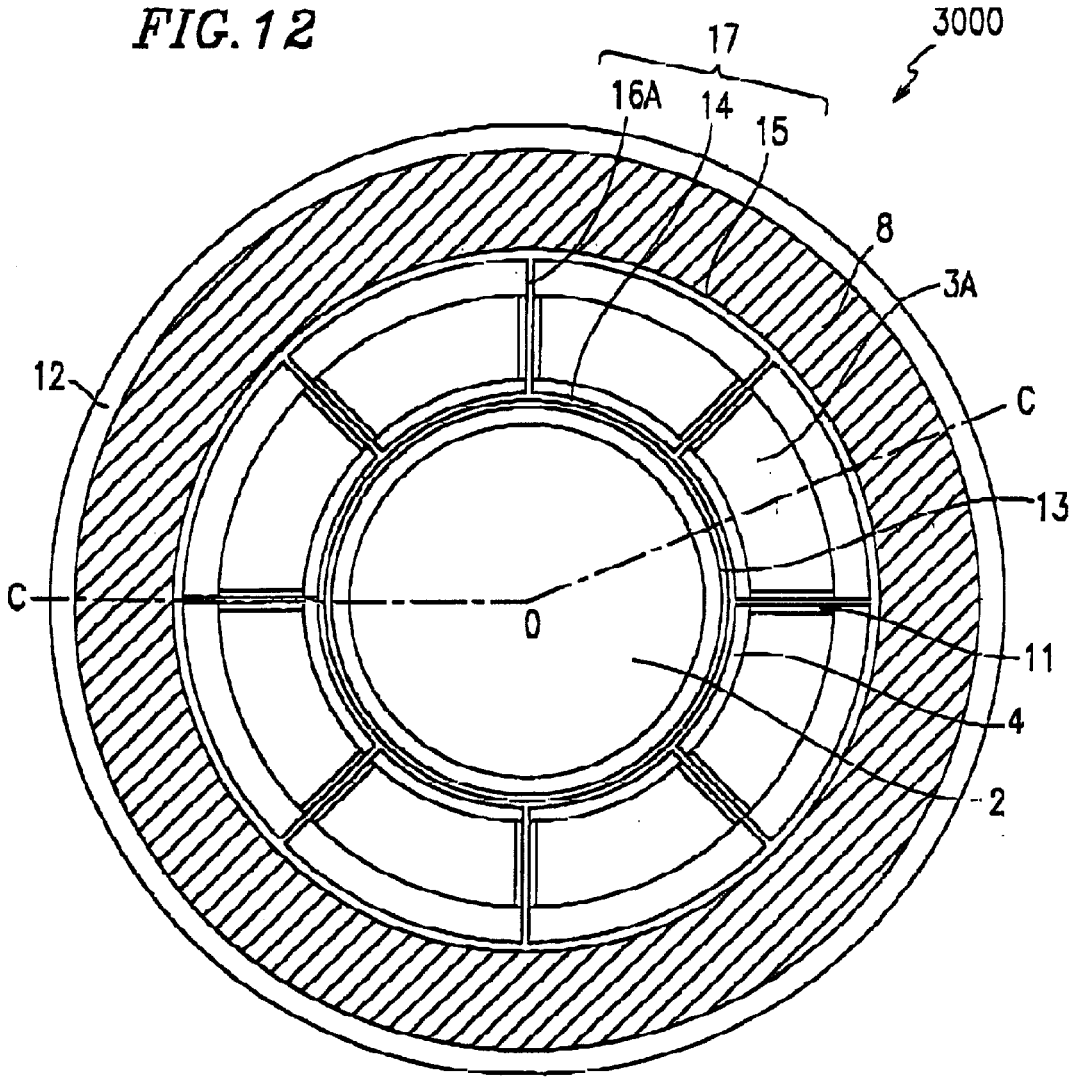
FIG. 12 is a plan view illustrating a loudspeaker according to Example 3 of the present invention.
Figure 13:
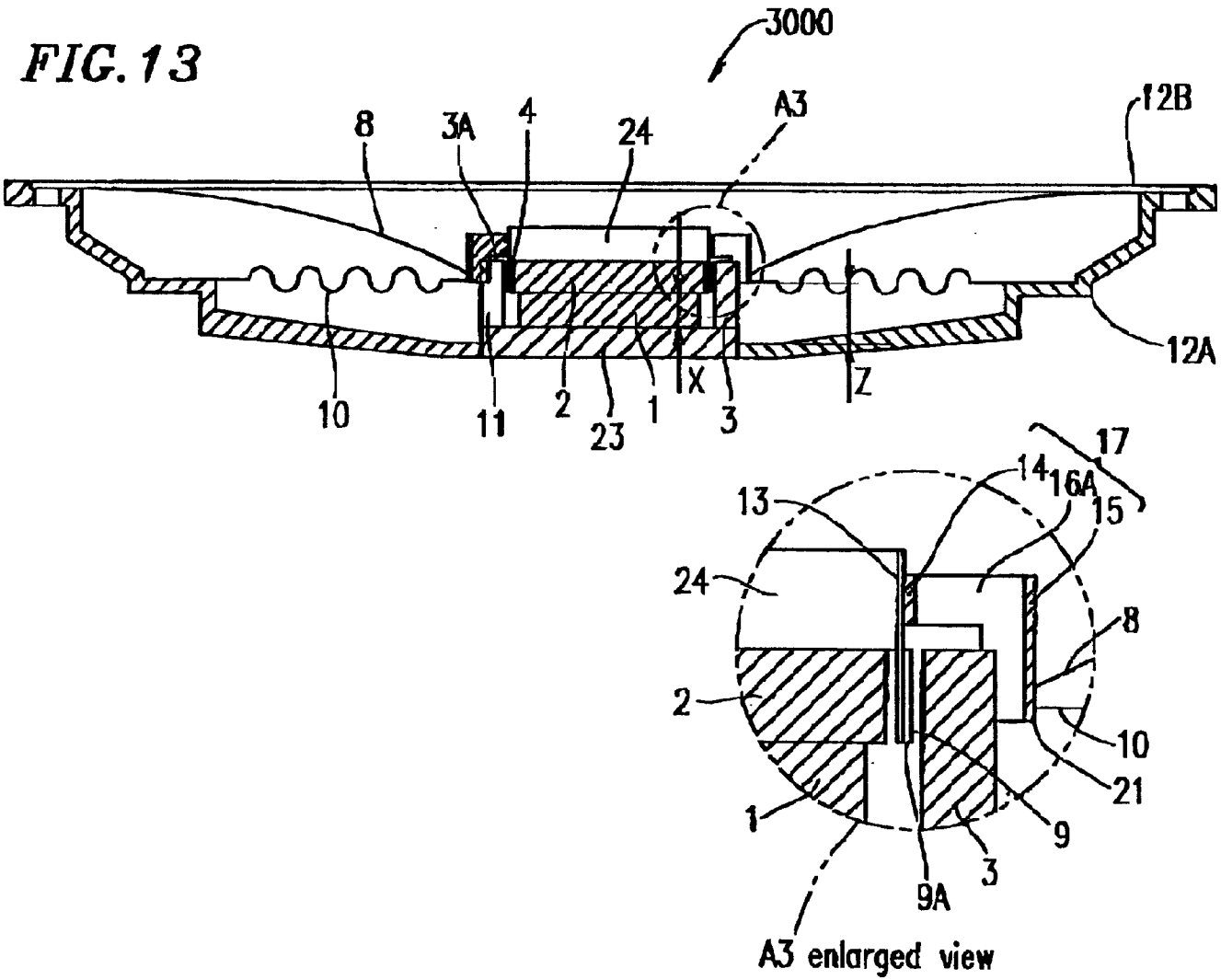
FIG. 13 is a cross-sectional view illustrating a loudspeaker according to Example 3 of the present invention.
Figure 14:
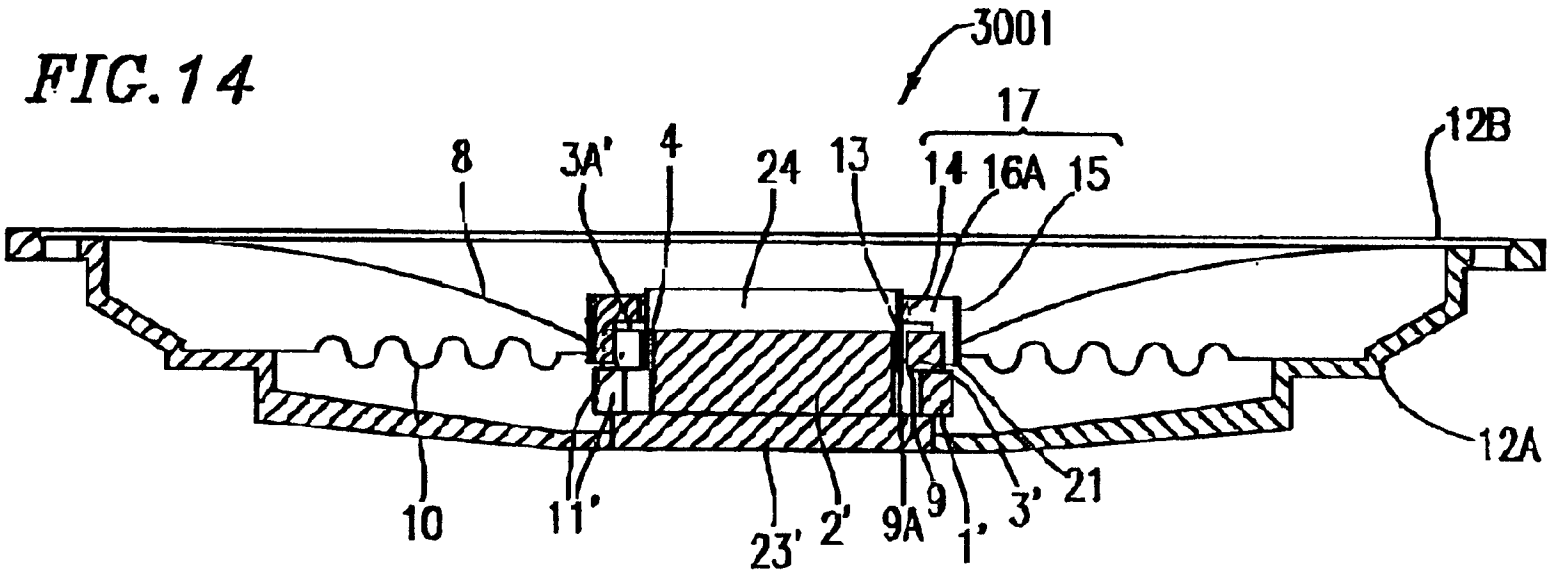
FIG. 14 is a cross-sectional view illustrating a loudspeaker according to Example 3 of the present invention incorporating an external type magnetic circuit.

FIG. 12 is a plan view illustrating a loudspeaker 3000 according to Example 3 of the present invention. FIG. 13 is a cross-sectional view illustrating the loudspeaker 3000, taken at line C-O-C in FIG. 12.

The loudspeaker 3000 includes a coupling member 17. The coupling member 17 has support members 16A, which are inserted into slits 11 provided in a yoke 3, and inner and outer annular members 14 and 15. The support members 16A are interposed between the inner and outer annular members 14 and 15. A voice coil bobbin 13 is affixed to the inner annular member 14, whereas a diaphragm 8 and dampers 10 are affixed to the outer annular member 15. As is the case with the support members 16 in Example 2, the support members 16A have a double-stepped shape. A bottom face 9A of the voice coil 9 is located below a bottom face 21 of the outer annular member 15. Otherwise, the loudspeaker 3000 has the same structure as that of the loudspeaker 2000.

Now, the operation of the above-described structure will be described.

The magnet 1, the yoke 3, a center pole 2, and a bottom plate 23 together compose a magnetic circuit. A magnetic flux is generated within a magnetic gap 4 by the magnetic circuit. As an electric input is supplied to the voice coil 9, a driving force is generated in the voice coil 9 according to Fleming's left-hand rule, causing the voice coil 9 to vibrate along a vertical direction. The driving force generated in the voice coil 9 is transmitted to the voice coil bobbin 13, the coupling members 17 and to the diaphragm 8. The diaphragm 8 is vibrated along the vertical direction with an amplitude in proportion to the electrical input to the voice coil 9, thereby emitting sound.

The effects provided by this structure will be described.

The voice coil 9 is wound around the outer periphery of the voice coil bobbin 13, and the inner annular member 14 is affixed to the outer periphery of the voice coil bobbin 13. Therefore, even if the wire diameter for the voice coil 9 is changed for loudspeaker characteristics adjustment, thereby also changing the outer diameter of the voice coil 9, the voice coil bobbin 13 always has a constant outer diameter. Therefore, there is no need to change the size of the inner diameter of the inner annular member 14. Thus, a single type of coupling member 17 can always be used for various types of voice coils 9 having different wire diameters for changing the loudspeaker characteristics during production. When mass producing various models, this presents the advantages of lower cost and ease of storage and management of component parts.

Since the support members 16A have a double-stepped shape, a junction portion between each support member 16A and the diaphragm 8 can be located close to the plane on which the voice coil 9 is located. Thus, the overall height of the loudspeaker 3000 can be reduced.

As shown in FIG. 13, the bottom face 9A of the voice coil 9 is located below the bottom face 21 of the outer annular member 15. Therefore, as far as the vibration along the vertical direction is concerned, an amplitude margin Z between the bottom face 21 of the outer annular member 15 and the frame 12A is equal to or greater than an amplitude margin X between the bottom face 9A of the voice coil 9 and the bottom plate 23. Therefore, only the amplitude margin X between the bottom face 9A of the voice coil 9 and the bottom plate 23 needs to be considered when designing an amplitude margin for the loudspeaker 3000. Thus, the design process can be facilitated, and defects associated with the collision between the bottom face 21 of the outer annular member 15 and the frame 12A can be minimized even when the loudspeaker 3000 is mass produced.

Especially, the overall height of the outer annular member 15 can be effectively reduced if the bottom face 21 of the outer annular member 15 is located above the bottom face 9A of the voice coil 9 (as shown in FIG. 13), as opposed to if the bottom face 21 of the outer annular member 15 is located below the bottom face 9A of the voice coil 9. Again, this will lead to a reduced mass of the coupling member 17, whereby the vibration performance of the loudspeaker 3000 can be enhanced.

Since the support members 16A of the loudspeaker 3000 are formed in a double-stepped shape as shown in FIG. 13, it is possible to reinforce the outer annular member 15 in its radial direction. As a result, the outer annular member 15 is prevented from having unwanted resonation, so that the driving force generated in the voice coil 9 can be transmitted to the diaphragm 8 without substantial loss. Thus, the coupling member 17 can be prevented from undergoing mechanical destruction without undermining the sound pressure characteristics and the sound quality of the loudspeaker 3000.

The coupling member 17 composed of the support members 16A and the inner and outer annular members 14 and 15 may be formed of a resin or metal material as an integral piece. The outer annular member 15 and the diaphragm 8 may be formed as an integral piece. The coupling member 17 and the diaphragm 8 may be formed as an integral piece. When such elements are formed as integral pieces, whereby the number of component parts can be reduced, the production process is facilitated and the product cost reduced.

The loudspeaker 3000 shown in FIG. 13 is an internal type magnetic circuit, i.e., the magnet 1 is affixed to a lower portion of the center pole 2. Alternatively, as in a loudspeaker 3001 shown in FIG. 14, a magnet 1' may be provided around the outer periphery of a center pole 2', and a plurality of slits 11' may be provided in both a magnet 1' and a yoke 3' to compose an external type magnetic circuit. The center pole 2' and the bottom plate 23' may be formed as an integral piece.

EXAMPLE 4

Figure 15:
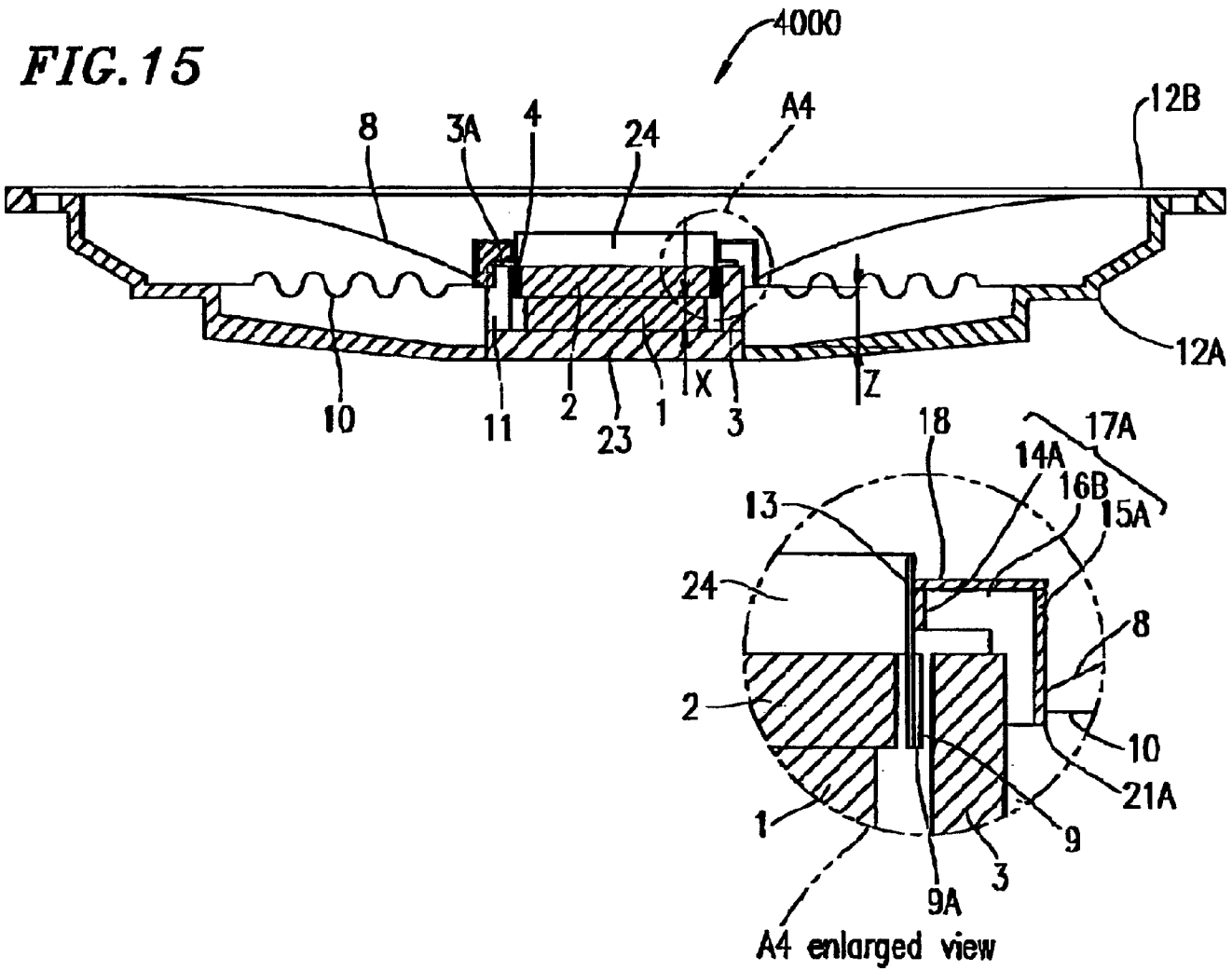
FIG. 15 is a cross-sectional view illustrating a loudspeaker according to Example 4 of the present invention.
Figure 16:
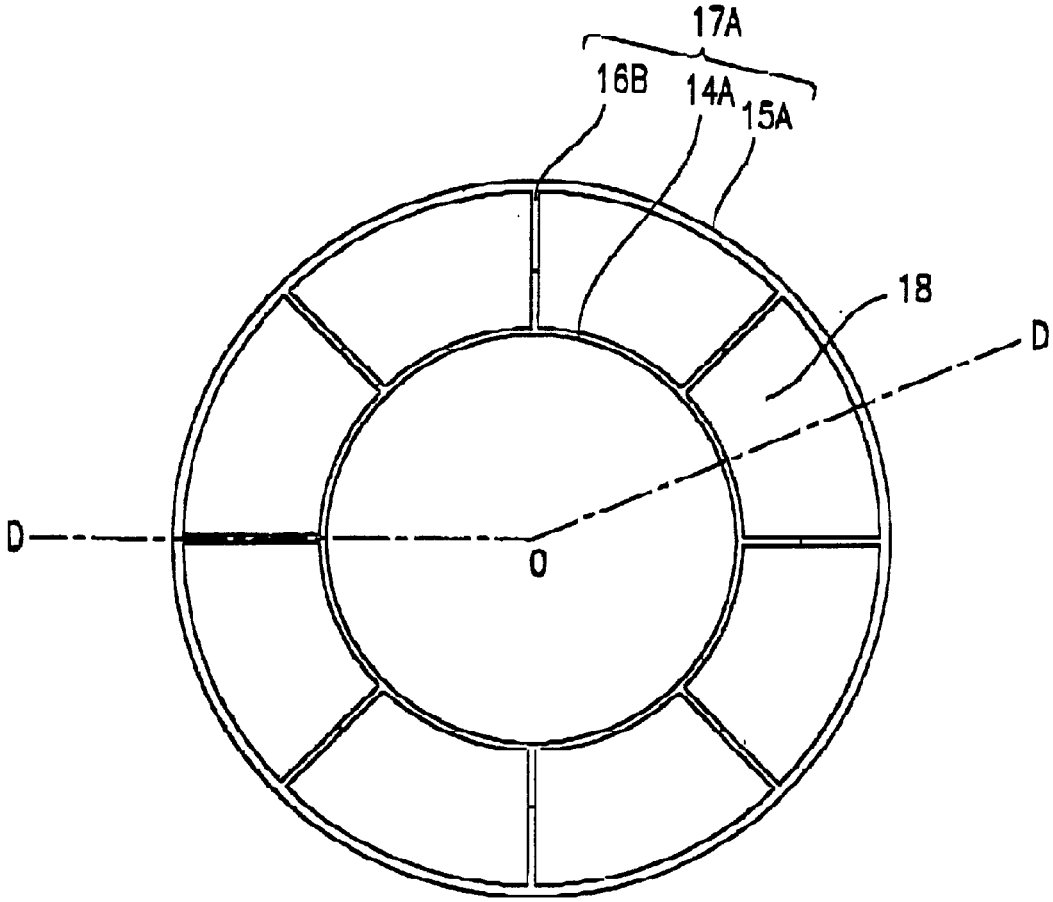
FIG. 16 is a bottom view illustrating a coupling member according to Example 4 of the present invention.

FIG. 15 is a cross-sectional view illustrating a loudspeaker 4000 according to Example 4 of the present invention. FIG. 16 is a plan view showing a coupling member 17A and a thin plate 18 of the loudspeaker 4000, as seen from the bottom side of the magnetic circuit of the loudspeaker 4000. The cross-sectional view of FIG. 15 is taken at line D-O-D in FIG. 16.

The loudspeaker 4000 includes the coupling member 17A. The coupling member 17A has support members 16B, which are inserted into slits 11 provided in a yoke 3, and inner and outer annular members 14A and 15A. The support members 16B are interposed between the inner and outer annular members 14A and 15A. A voice coil bobbin 13 is affixed to the inner annular member 14A, whereas a diaphragm 8 and dampers 10 are affixed to the outer annular member 15A. As is the case with the support members 16A in Example 3, the support members 16B have a double-stepped shape. The support members 16B are connected at their upper ends by means of the thin plate 18. A bottom face 9A of the voice coil 9 is located below a bottom face 21A of the outer annular member 15A. Otherwise, the loudspeaker 4000 has the same structure as that of the loudspeaker 3000.

The coupling member 17A has the same function as that of the coupling member 17 in the loudspeaker 3000 according to Example 3. The operation and effects provided by the loudspeaker 4000 are similar to those of the loudspeaker 3000.

In addition, the thin plate 18, which covers the upper face of the slits 11 and the upper face of the yoke 3A, prevents dust from gathering at the slits 11 and the magnetic gap 4. By designing the thin plate 18 so as to resonate or vibrate in a high-frequency region in the neighborhood of, e.g., 10 kHz, it becomes possible to provide compensation for the high-frequency characteristics of the loudspeaker 4000. The thin plate 18 further provides reinforcement effects for the coupling member 17A.

Figure 17:
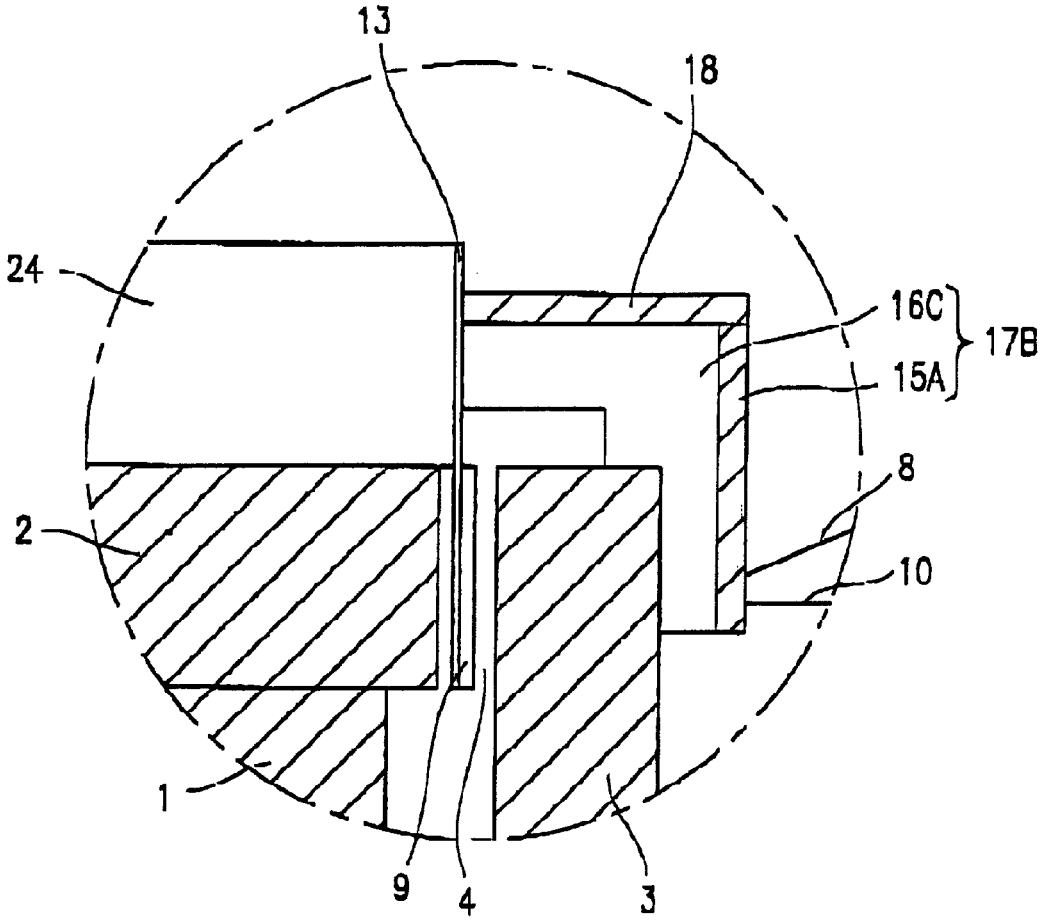
FIG. 17 is a partial cross-sectional view illustrating a modification of the loudspeaker according to Example 4 of the present invention in the neighborhood of a coupling member having an alternative configuration.
Figure 18:
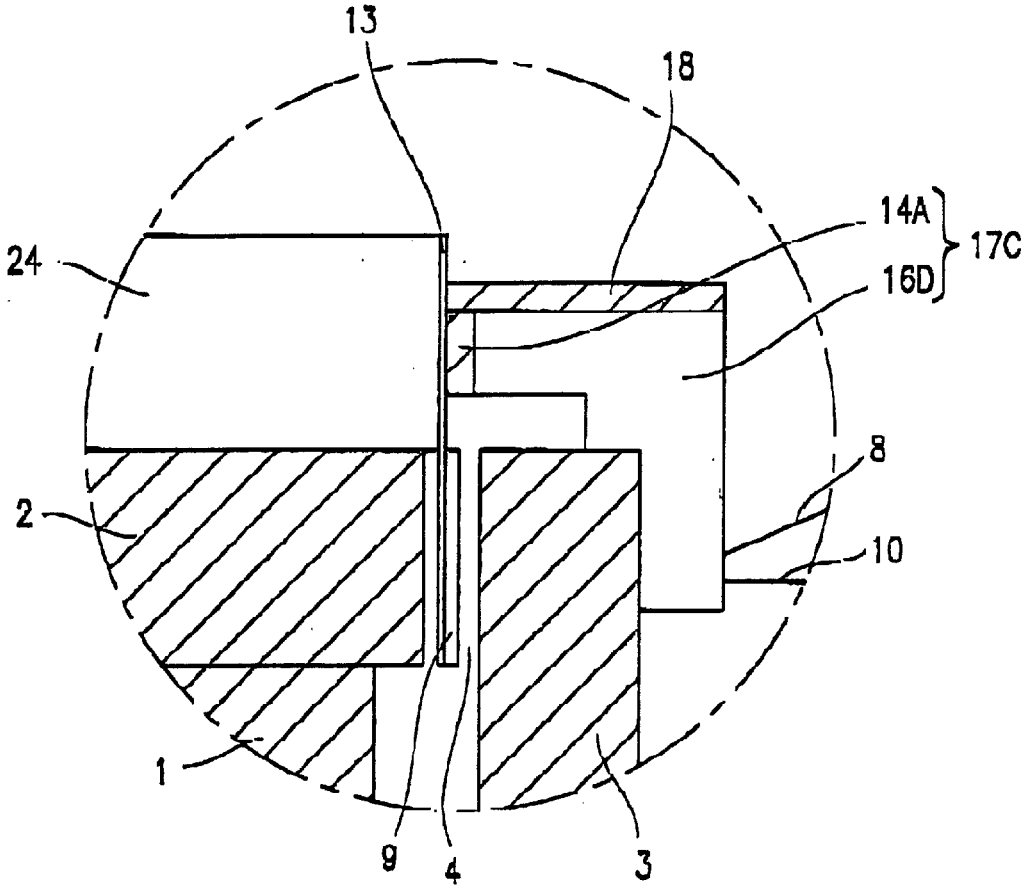
FIG. 18 is a partial cross-sectional view illustrating a modification of the loudspeaker according to Example 4 of the present invention in the neighborhood of a coupling member having an alternative configuration.

FIGS. 17 and 18 are partial cross-sectional views illustrating modifications of the loudspeaker 4000 having variants 17B and 17C, respectively, of the coupling member 17A according to Example 4 of the present invention.

The coupling member 17B shown in FIG. 17 includes support members 16C and an annular member 15A. The coupling member 17B differs from the coupling member 17A in that the inner annular member 14A is omitted, and the voice coil bobbin 13 is affixed to the support members 16C. Since the mass of the coupling member 17B is reduced by the mass of the inner annular member 14A, the vibration performance of the loudspeaker 4000 can be enhanced.

The coupling member 17C shown in FIG. 18 includes support members 16D and an annular member 14A. The coupling member 17C differs from the coupling member 17A in that the annular member 15A is omitted. Since the mass of the coupling member 17C is reduced by the mass of the annular member 15A, the vibration performance of the loudspeaker 4000 can be enhanced.

Figure 19:
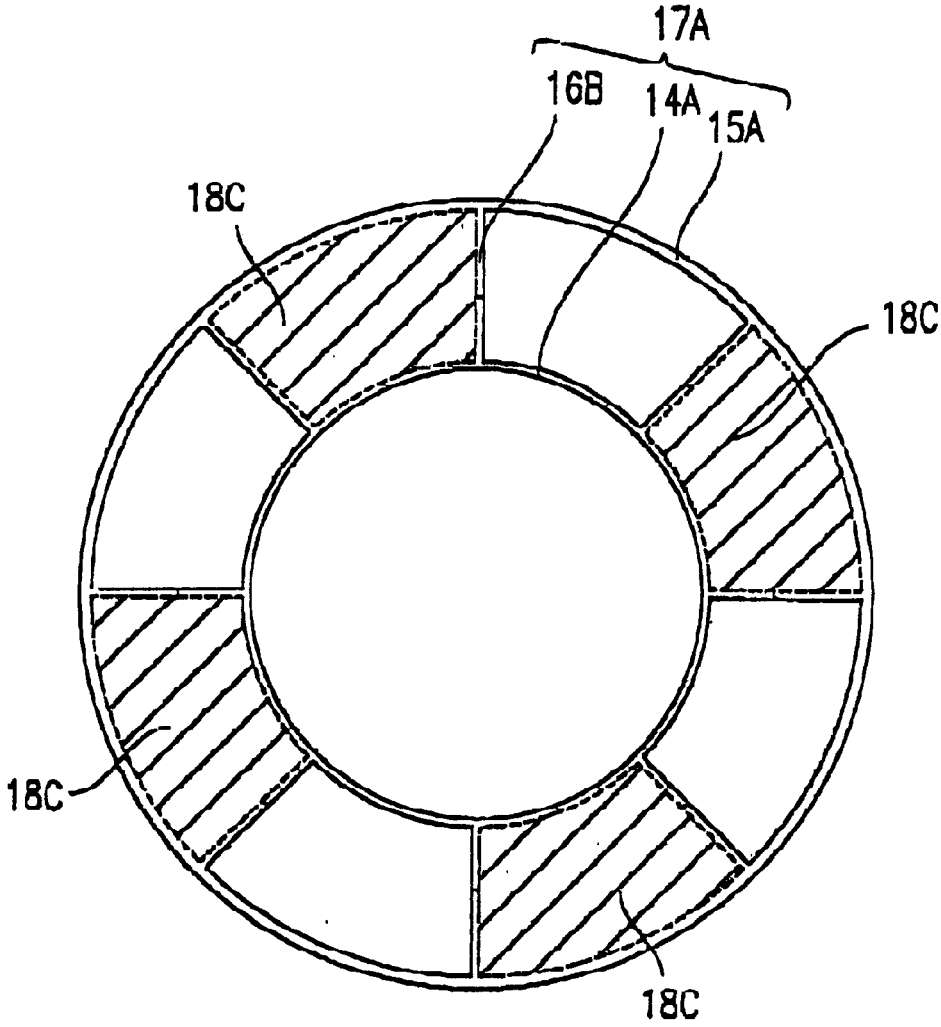
FIG. 19 is a plan view illustrating a variant of the coupling member according to Example 4 of the present invention.

FIG. 19 is a plan view illustrating a variant of the thin plate 18 provided on the upper face of the coupling member 17A according to Example 4 of the present invention. As shown in FIG. 19, thin plates 18C provide partial coupling between the upper faces of the support members 16B. By adjusting the number of such thin plates 18C, it is possible to adjust the total mass of the coupling member 17A and the thin plates 18C.

Figure 20:
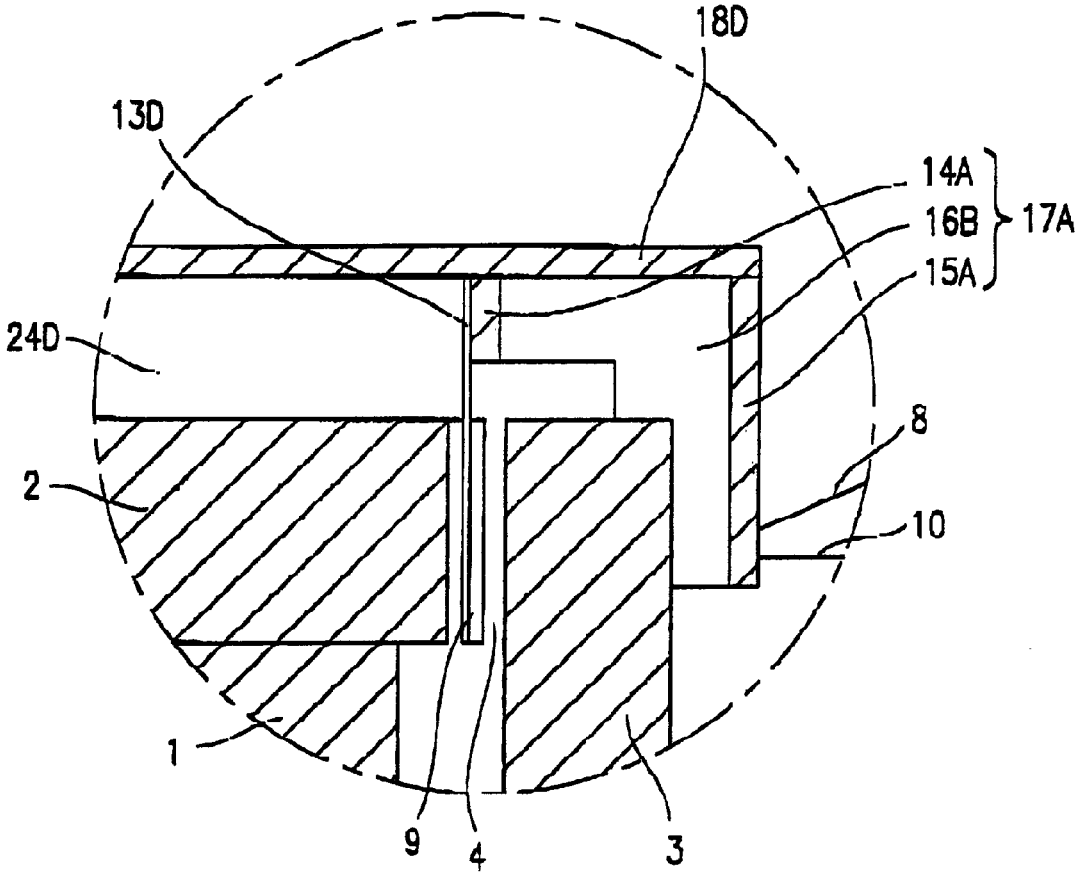
FIG. 20 is a partial cross-sectional view illustrating a modification of the loudspeaker according to Example 4 of the present invention in the neighborhood of a coupling member having an alternative configuration.
Figure 21:
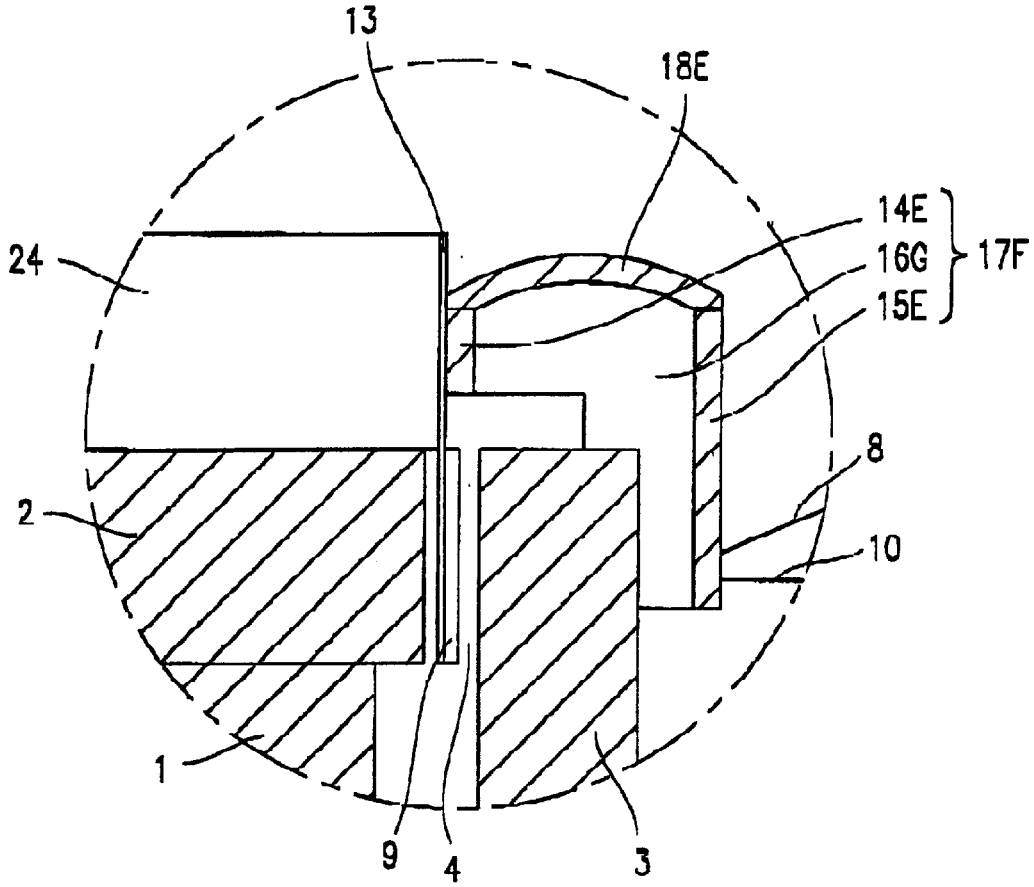
FIG. 21 is a partial cross-sectional view illustrating a modification of the loudspeaker according to Example 4 of the present invention in the neighborhood of a coupling member having an alternative configuration.

FIGS. 20 and 21 are partial cross-sectional views illustrating modifications of the loudspeaker 4000 having variants 18D and 18E, respectively, of the thin plate 18 according to Example 4 of the present invention.

The thin plate 18D shown in FIG. 20 covers the entire coupling member 17A. A voice coil bobbin 13D and a cover 24D may have, as shown, their size adapted to the thin plate 18D. Since the thin plate 18D covers the entire coupling member 17A, the magnetic circuit of the loudspeaker 4000 is protected from dust, and the high-frequency characteristics of the loudspeaker 4000 can be adjusted. In this case, the cover 24D may be omitted.

The cross section of the thin plate 18E shown in FIG. 21 presents an arc shape. Through such modification of the cross-sectional shape of the thin plate 18E, it becomes possible to adjust the high-frequency characteristics of the loudspeaker 4000. A coupling member 17F, as one variant of the coupling member 17A, includes support members 16G and inner and outer annular members 14E and 15E which are adapted to the arc shape of the thin plate 18E.

Figure 22:
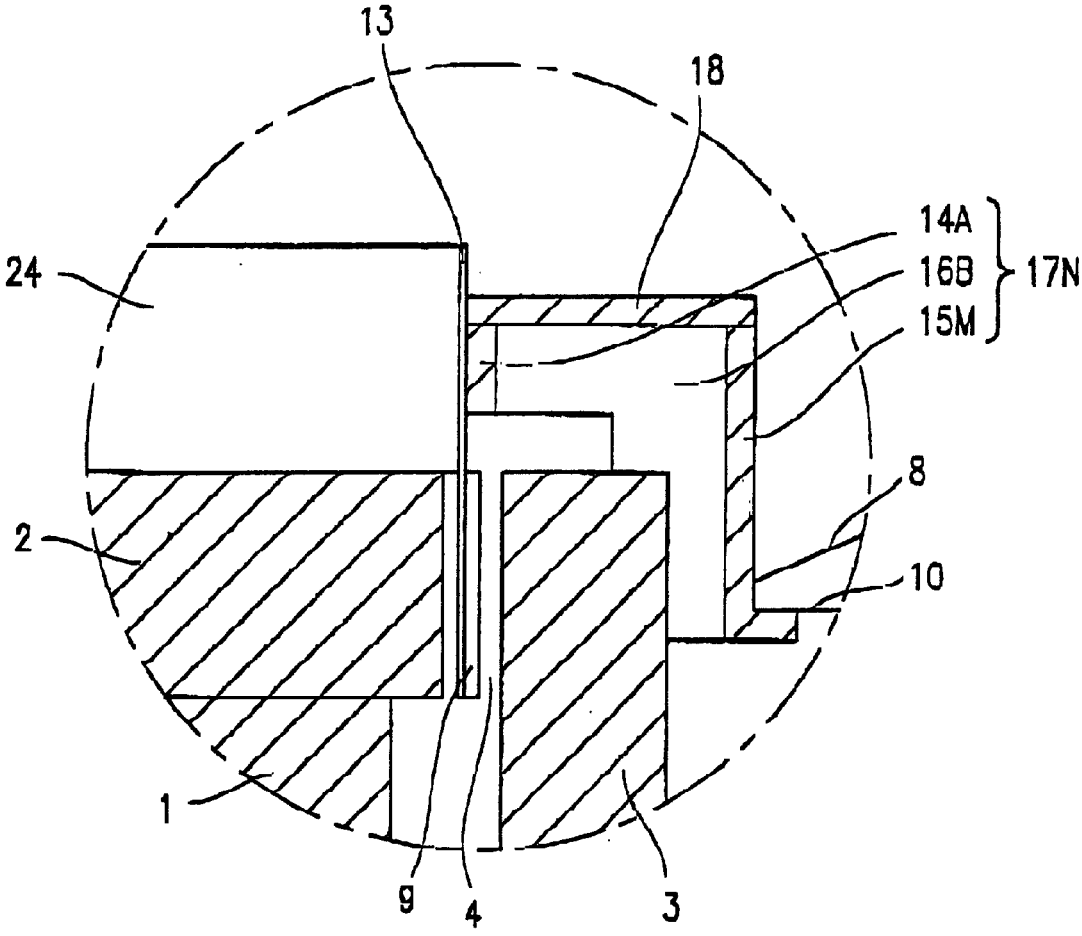
FIG. 22 is a partial cross-sectional view illustrating a modification of the loudspeaker according to Example 4 of the present invention in the neighborhood of a coupling member having an alternative configuration.
Figure 23:
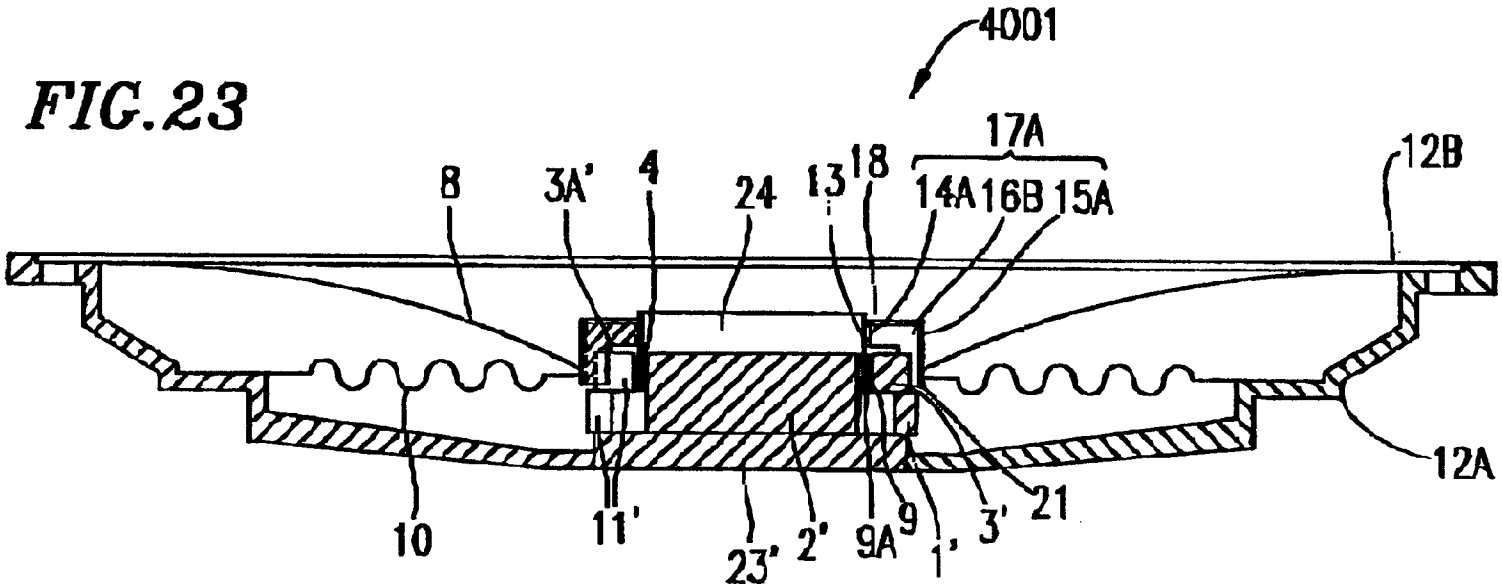
FIG. 23 is a cross-sectional view illustrating a loudspeaker according to Example 4 of the present invention incorporating an external type magnetic circuit.

A coupling member 17N shown in FIG. 22, which is one variant of the coupling member 17A, is such that an annular member 15M located at the outer periphery of the coupling member 17N presents an L-shaped cross section. Such an annular member 15M has a more enhanced mechanical strength than that of the annular member 15A. FIG. 22 is a partial cross-sectional view illustrating a modification of the loudspeaker 4000. Since the diaphragm 8 or the dampers 10 can be adhered to the convex underpart of the L-shaped annular member 15M, the production process can be facilitated, and the adhesion strength of the diaphragm 8 and the dampers 10 to the coupling member 17N can be enhanced. As a result, the loudspeaker 4000 is made more mechanically durable.

Any of the coupling members 17A, 17B, 17C, 17F, and 17N may be formed as a single integral piece. Any of the coupling members 17A, 17B, 17C, 17F, and 17N, and a corresponding one of the thin plates 18, 18C and 18E, may be formed as an integral piece using a resin or metal material, etc., or as an assembly of elements composed of different materials.

Any of the annular members 15A, 15E and 15M and the diaphragm 8 may be formed as an integral piece. Any of the coupling members 17A, 17B, 17C, 17F and 17N and the diaphragm 8 may be formed as an integral piece.

Any one of the various structures described above may be selected as appropriate at the time of production, while paying attention to factors such as ease of production, mass, reinforcement effects, and the high-frequency characteristics adjustments of the loudspeaker 4000.

The loudspeaker 4000 shown in FIG. 16 is an internal type magnetic circuit, i.e., the magnet 1 is affixed to a lower portion of the center pole 2. Alternatively, as in a loudspeaker 4001 shown in FIG. 23, a magnet 1' may be provided around the outer periphery of a center pole 2', and a plurality of slits 11' may be provided in both a magnet 1' and a yoke 3' to compose an external type magnetic circuit.

EXAMPLE 5

Figure 24:
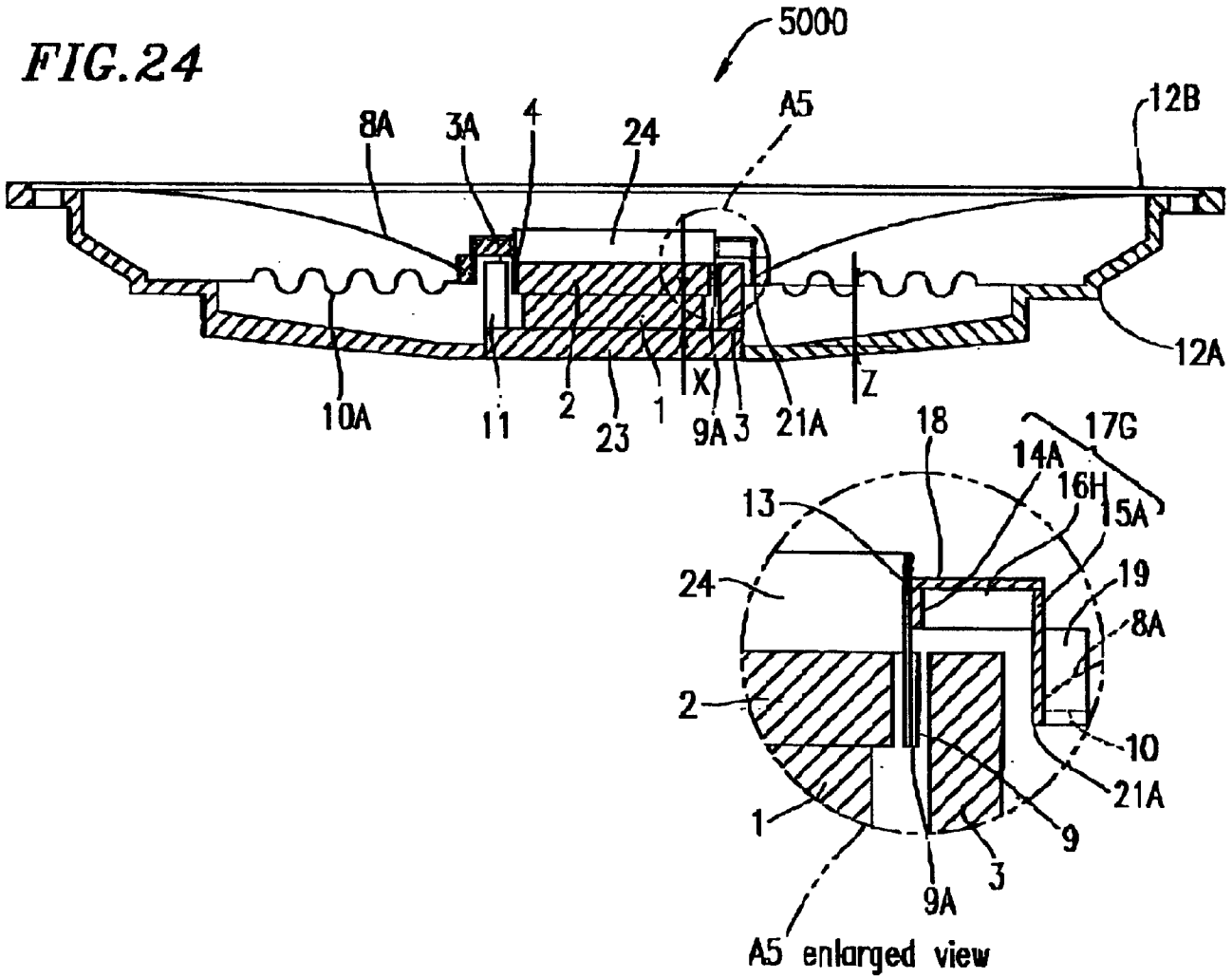
FIG. 24 is a cross-sectional view illustrating a loudspeaker according to Example 5 of the present invention.
Figure 25:
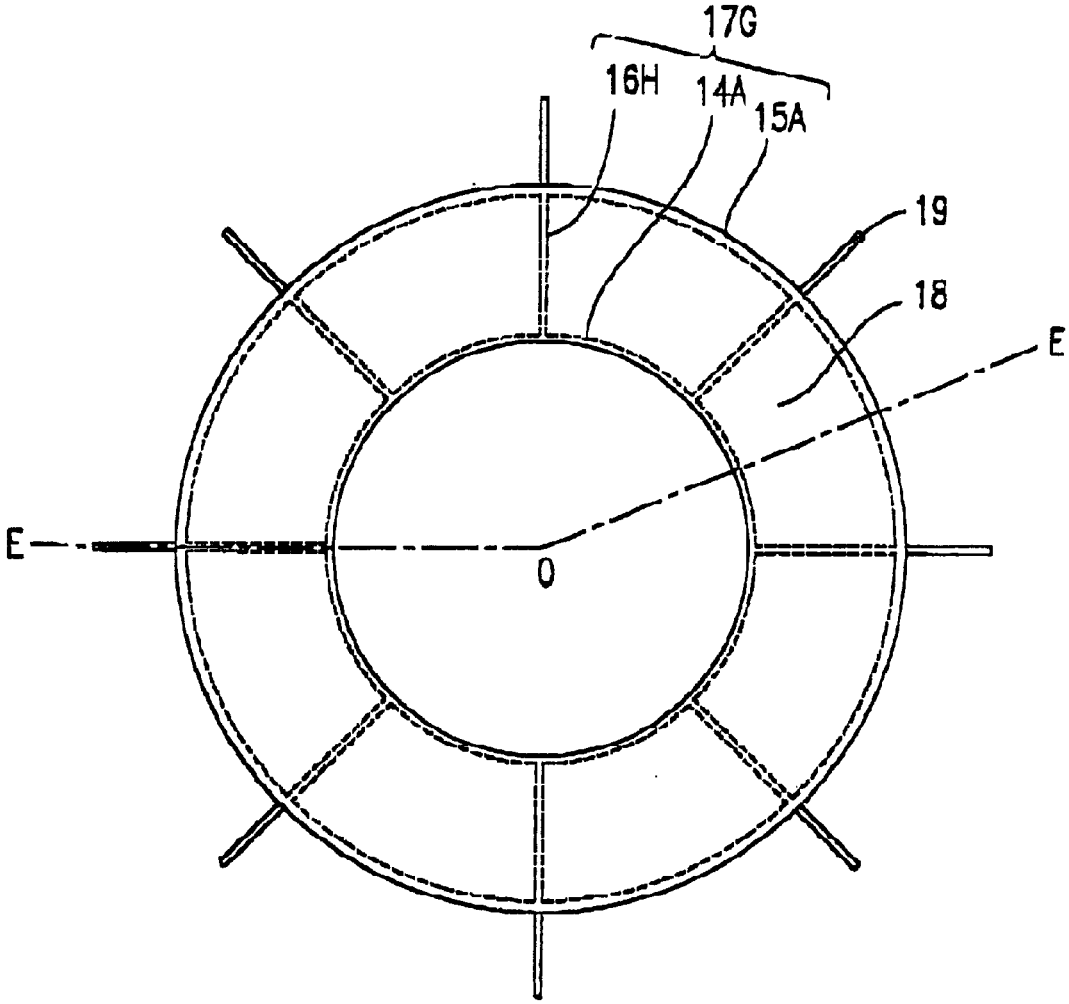
FIG. 25 is a plan view illustrating a coupling member and thin plates according to Example 5 of the present invention.

FIG. 24 is a cross-sectional view illustrating a loudspeaker 5000 according to Example 5 of the present invention. FIG. 25 is a plan view showing a coupling member 17G and thin plates 18 and 19 of-the loudspeaker 5000. The cross-sectional view of FIG. 24 is taken at line E-O-E in FIG. 25.

The loudspeaker 5000 includes the coupling member 17G. The coupling member 17G has support members 16H, which are inserted into slits 11 provided in a yoke 3, and inner and outer annular members 14A and 15A. The support members 16H are interposed between the inner and outer annular members 14A and 15A. A voice coil bobbin 13 is affixed to the inner annular member 14A, whereas a diaphragm 8A and dampers 10 are affixed to the outer annular member 15A. The support members 16H have a rectangular cross section for ease of molding. The support members 16H are connected at their upper ends by means of the thin plate 18. In addition, the thin plates 19 are attached to the outer periphery of the outer annular member 15A, thereby reinforcing the outer annular member 15A. The illustrated diaphragm 8A has a shape which would be left after omitting any portion overlapping between the thin plates 19 and the diaphragm 8A. Alternatively, the diaphragm 8 may be employed instead of the diaphragm 8A, on the proviso that the diaphragm 8 and the thin plates 19 are not provided in an overlapping relationship with each other. Otherwise, the loudspeaker 5000 has the same structure as that of the loudspeaker 4000. A bottom face 9A of the voice coil 9 is located below a bottom face 21A of the outer annular member 15A.

The coupling member 17G has the same function as that of the coupling member 17A in the loudspeaker 4000 according to Example 4. The support members 16H may have a stepped shape, as is the case with the support members 16B shown in FIG. 28.

The operation and effects provided by the loudspeaker 5000 are similar to those of the loudspeaker 4000 according to Example 4.

In addition, the thin plates 19 affixed to the outer periphery of the outer annular member 15A serve to enhance the reinforcement effects for the outer annular member 15A, or the coupling member 17G.

Figure 26:
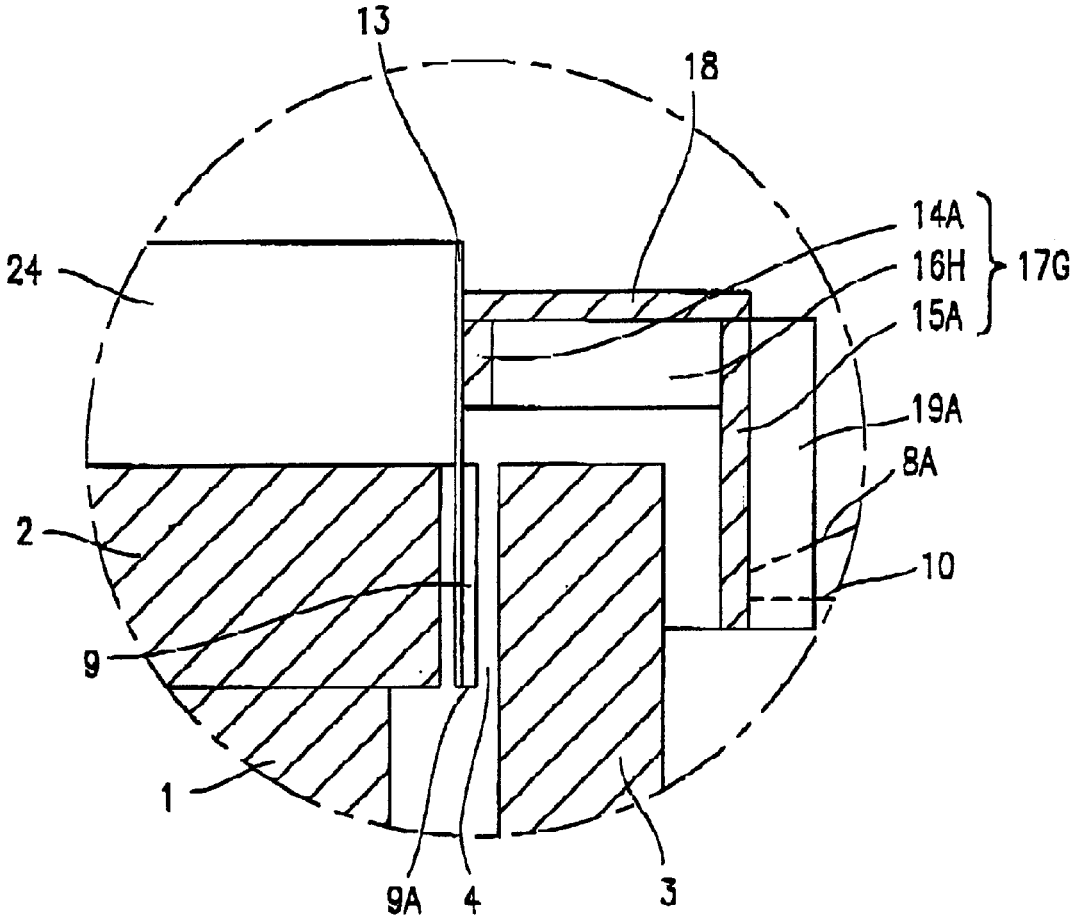
FIG. 26 is a partial cross-sectional view illustrating a modification of the loudspeaker according to Example 5 of the present invention in the neighborhood of a coupling member having an alternative configuration.

Although the height of the thin plates 19 along the direction of vibration is shown to extend up to the plane on which the bottom faces of the support members 16H are located in FIG. 24, the thin plates 19 may be further elongated as shown in FIG. 26 for enhanced reinforcement effects. FIG. 26 is a partial cross-sectional view illustrating a modification of the loudspeaker 5000.

Figure 27:
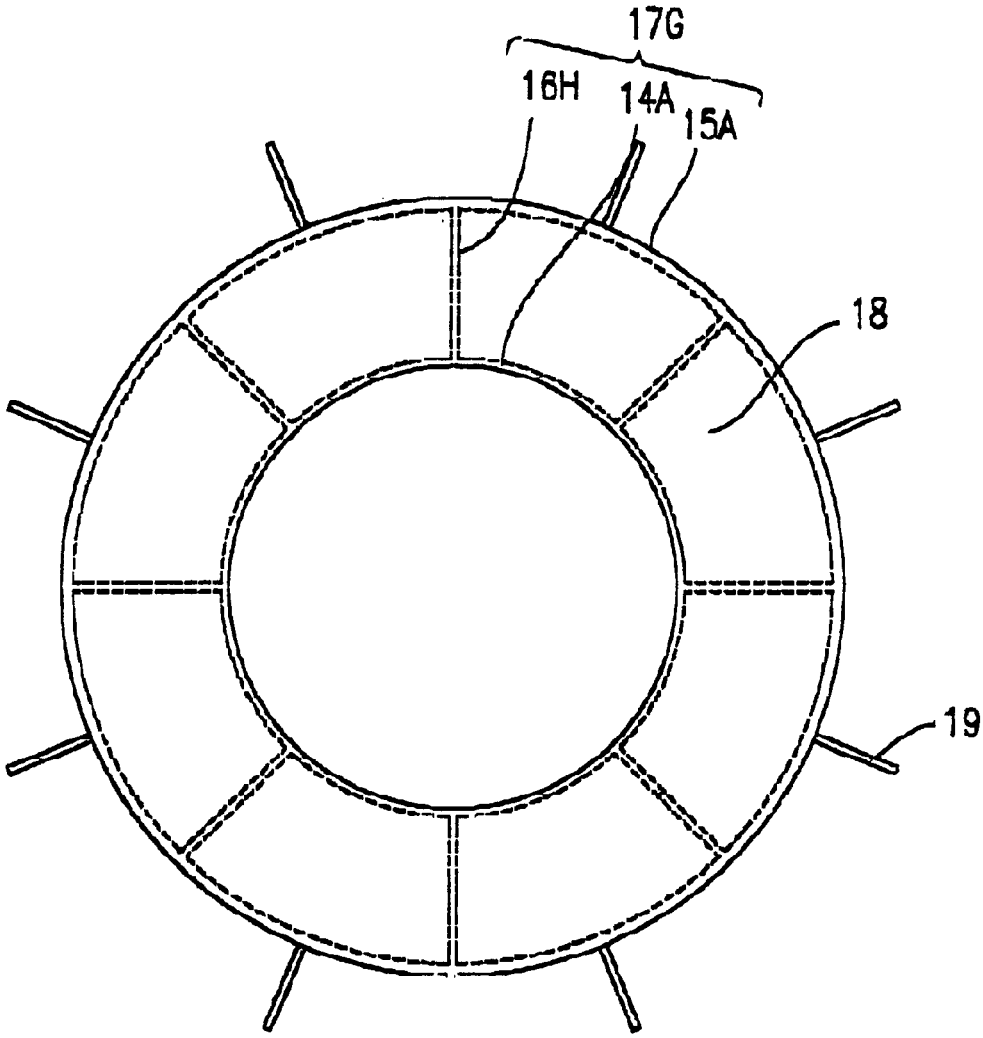
FIG. 27 is a plan view illustrating a variant of a coupling member and thin plates according to Example 5 of the present invention.

Furthermore, as shown in FIG. 27, the support members 16H and the thin plates 19 do not need to be aligned on the same lines along radial directions. The number of thin plates 19 and the number of support members 16H do not need to be equal.

The aforementioned modification may be selected as appropriate at the time of production, while paying attention to factors such as reinforcement effects, mass, and ease of production of the loudspeaker 5000.

The loudspeaker 5000 shown in FIG. 24 is an internal type magnetic circuit, i.e., the magnet 1 is affixed to a lower portion of the center pole 2. Alternatively, as in a loudspeaker 5001 shown in FIG. 29, a magnet 1' may be provided around the outer periphery of a center pole 2', and a plurality of slits 11' may be provided in both a magnet 1' and a yoke 3' to compose an external type magnetic circuit.

Figure 28:
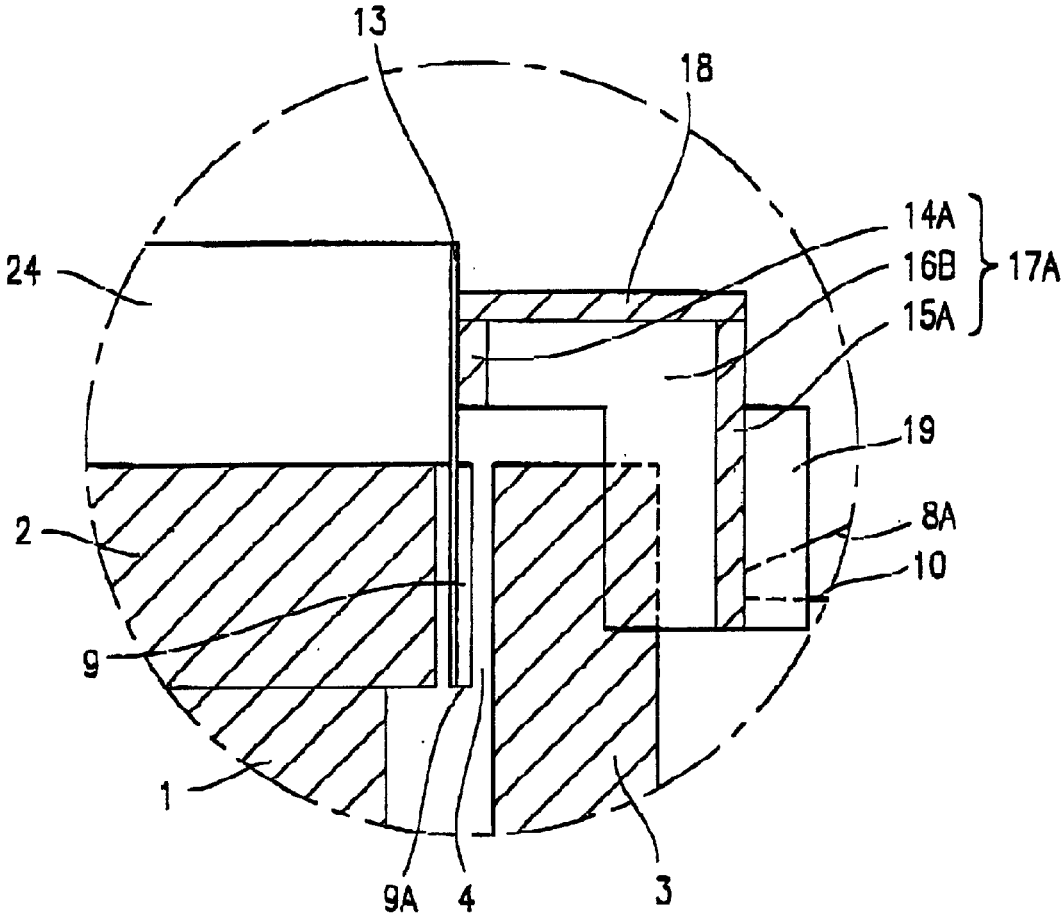
FIG. 28 is a partial cross-sectional view illustrating a modification of the loudspeaker according to Example 5 of the present invention in the neighborhood of a coupling member having an alternative configuration.
Figure 29:
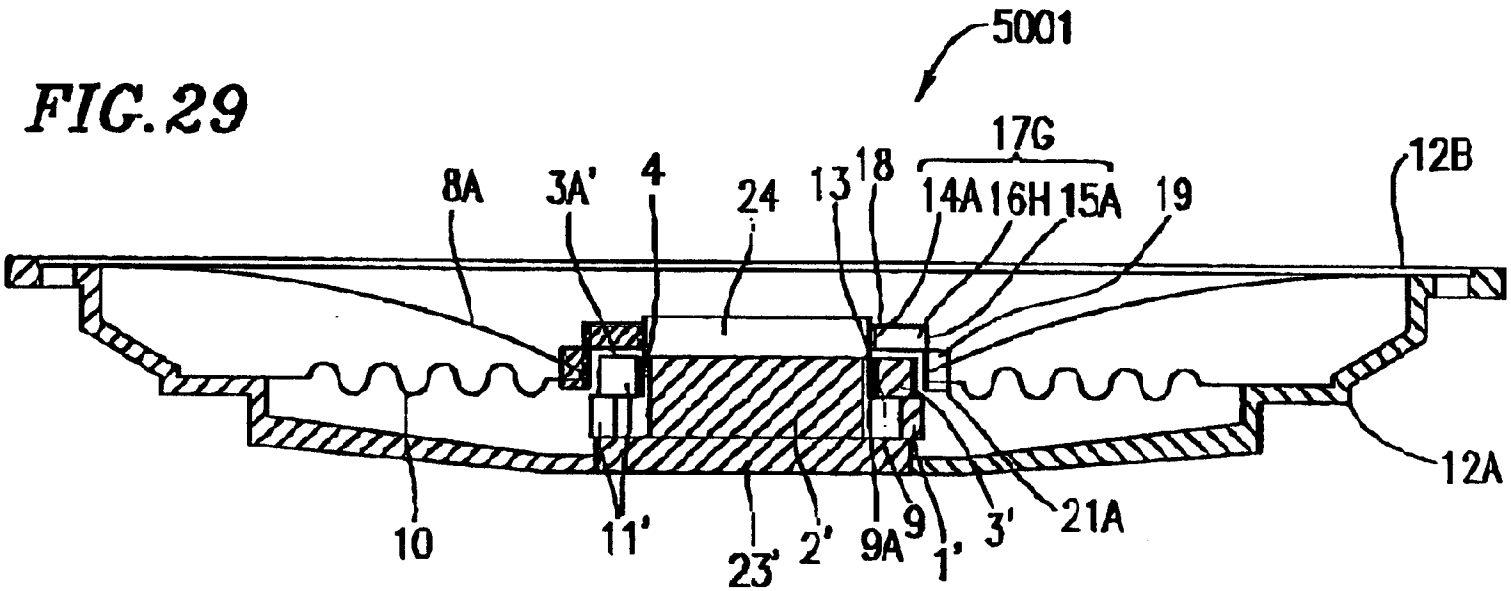
FIG. 29 is a cross-sectional view illustrating a loudspeaker according to Example 5 of the present invention incorporating an external type magnetic circuit.
Figure 30:
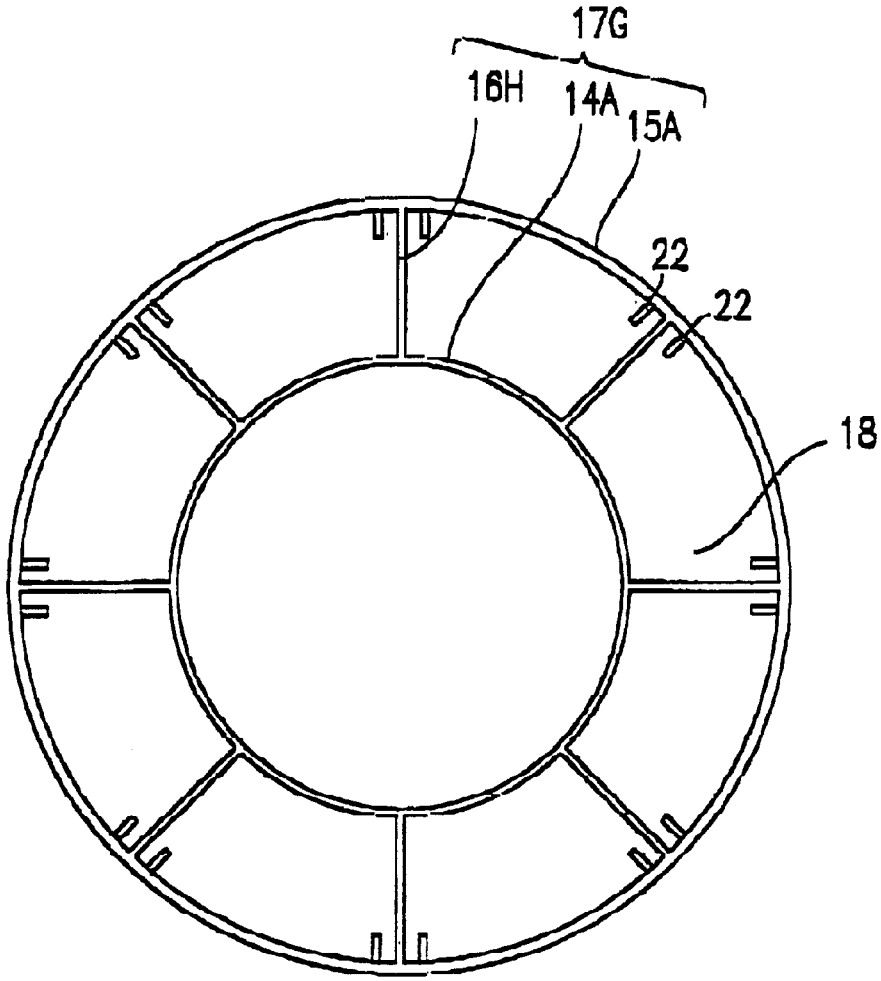
FIG. 30 is a bottom view illustrating a variant of a coupling member and thin plates according to Example 5 of the present invention.
Figure 31:
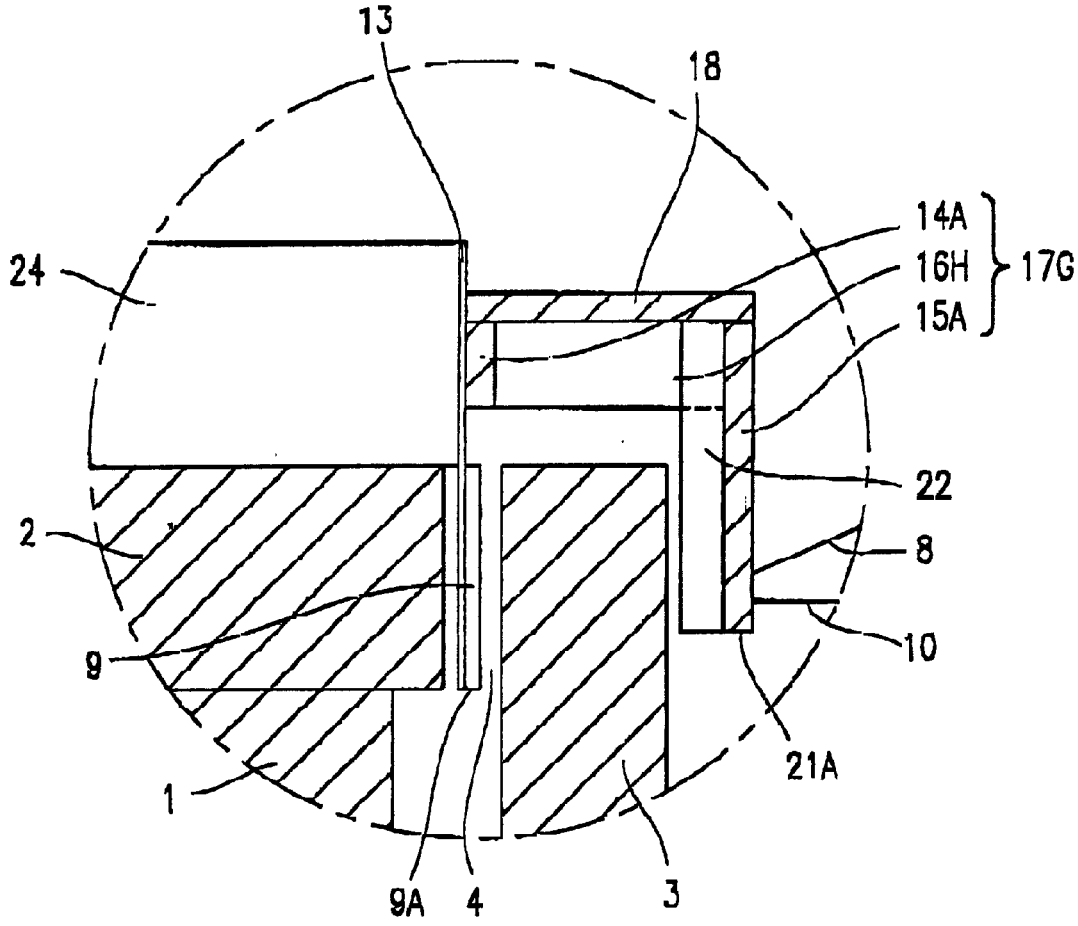
FIG. 31 is a partial cross-sectional view illustrating a modification of the loudspeaker according to Example 5 of the present invention in the neighborhood of a coupling member having an alternative configuration.

Alternatively, the thin plates 19 may be provided at the inner periphery of the outer annular member 15A. Such modifications are illustrated in FIGS. 30 and 31. FIG. 30 is a bottom view of the coupling member 17G. FIG. 31 is a partial cross-sectional view of a modified loudspeaker 5000. As shown in FIG. 30, at the inner periphery of the outer annular member 15A, thin plates 22 are provided as reinforcement elements, which serve to enhance the reinforcement effects for the outer annular member 15A or the coupling member 17G. By placing the reinforcement elements 22 in the neighborhood of the support members 16H on the inner periphery of the outer annular member 15A as shown in FIG. 30, particularly strong reinforcement effects are provided for portions of the coupling member 17G present between the respective support members 16H. Thus, such reinforcement elements 22 may be effectively employed in the case where the support members 16H alone cannot provide adequate reinforcement. The support members 16H may have a stepped shape, as is the case with the support members 16B shown in FIG. 28. FIG. 28 is a partial cross-sectional illustrating a modified loudspeaker 5000.

In the case where the thin plates 19 are provided at the outer periphery of the outer annular member 15A (as shown in FIG. 25), it is necessary to ensure that the diaphragm 8 and the dampers 10 are adapted so as not to interfere with such thin plates 19. On the other hand, the thin plates 22 provided at the inner periphery of the outer annular member 15A (as shown in FIG. 30), which replace the thin plates 19, facilitate the attachment of the diaphragm 8 and/or the dampers 10 to the outer annular member 15A, thereby facilitating the production process, without undermining the reinforcement effects.

Figure 32:
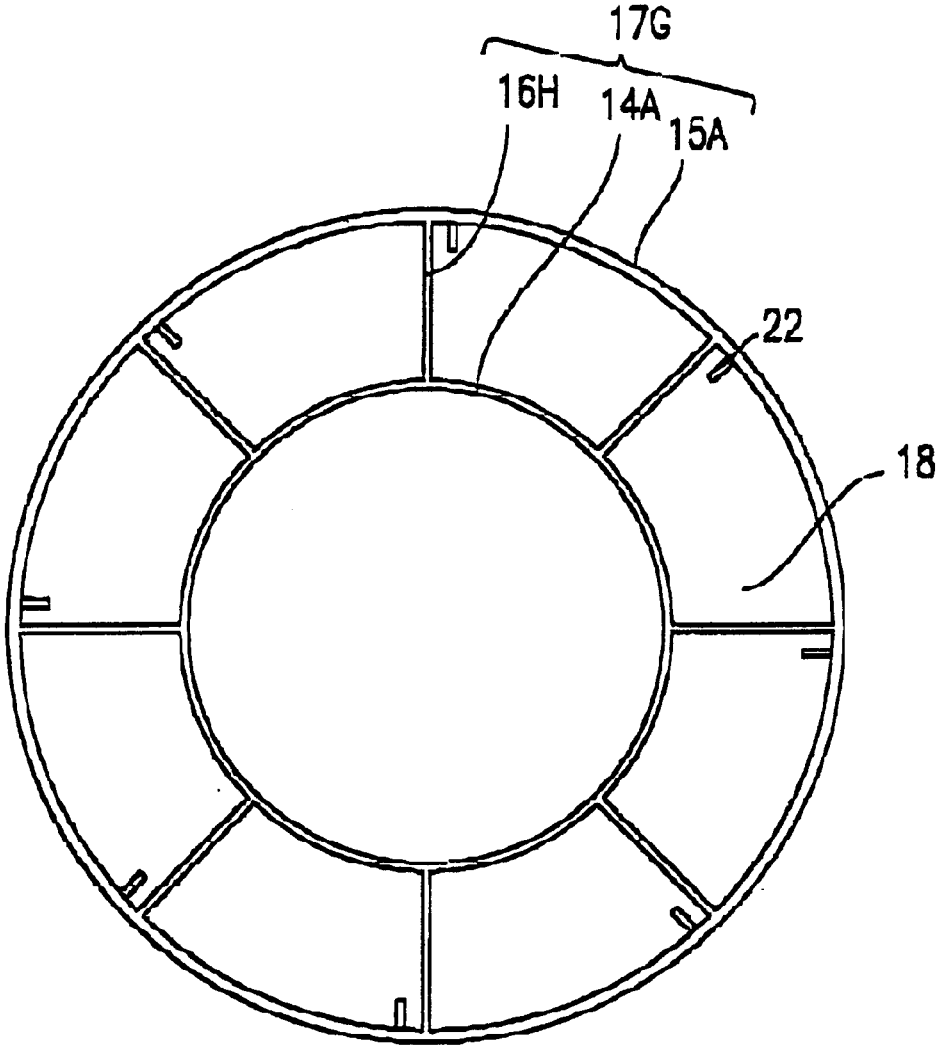
FIG. 32 is a bottom view illustrating a variant of a coupling member and thin plates according to Example 5 of the present invention.
Figure 33:
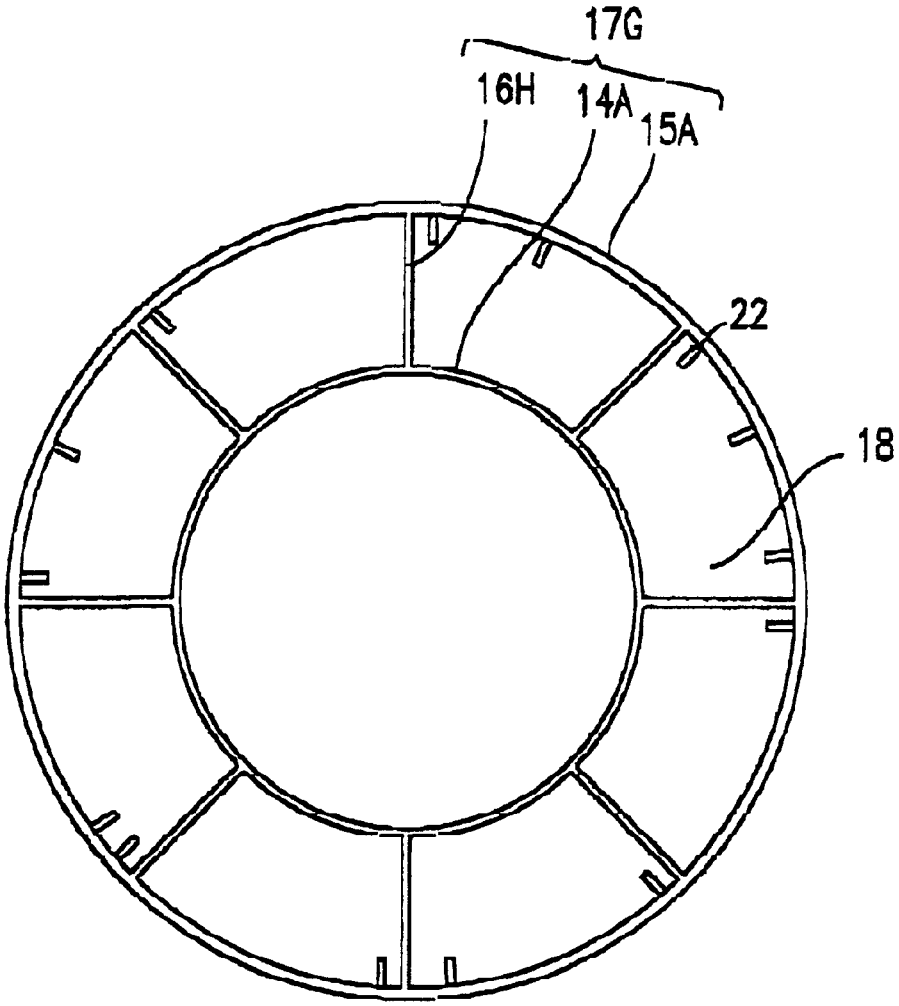
FIG. 33 is a bottom view illustrating a variant of a coupling member and thin plates according to Example 5 of the present invention.

Alternatively, the thin plates 22 may be provided on only one side of each support members 16H as shown in FIG. 32, or in a random deployment as shown in FIG. 33. Such arrangements will help to disperse a resonance frequency distribution of the coupling member 17G, so as to minimize any unfavorable effects on the loudspeaker characteristics that are associated with a single resonance frequency.

It will be appreciated that, the support members 16H in FIGS. 24, 26, 29, and 31, which are not illustrated as being inserted in the slits 11 or 11', are to be inserted in the slits 11 or 11' when driving the voice coil 9.

EXAMPLE 6

Figure 34:
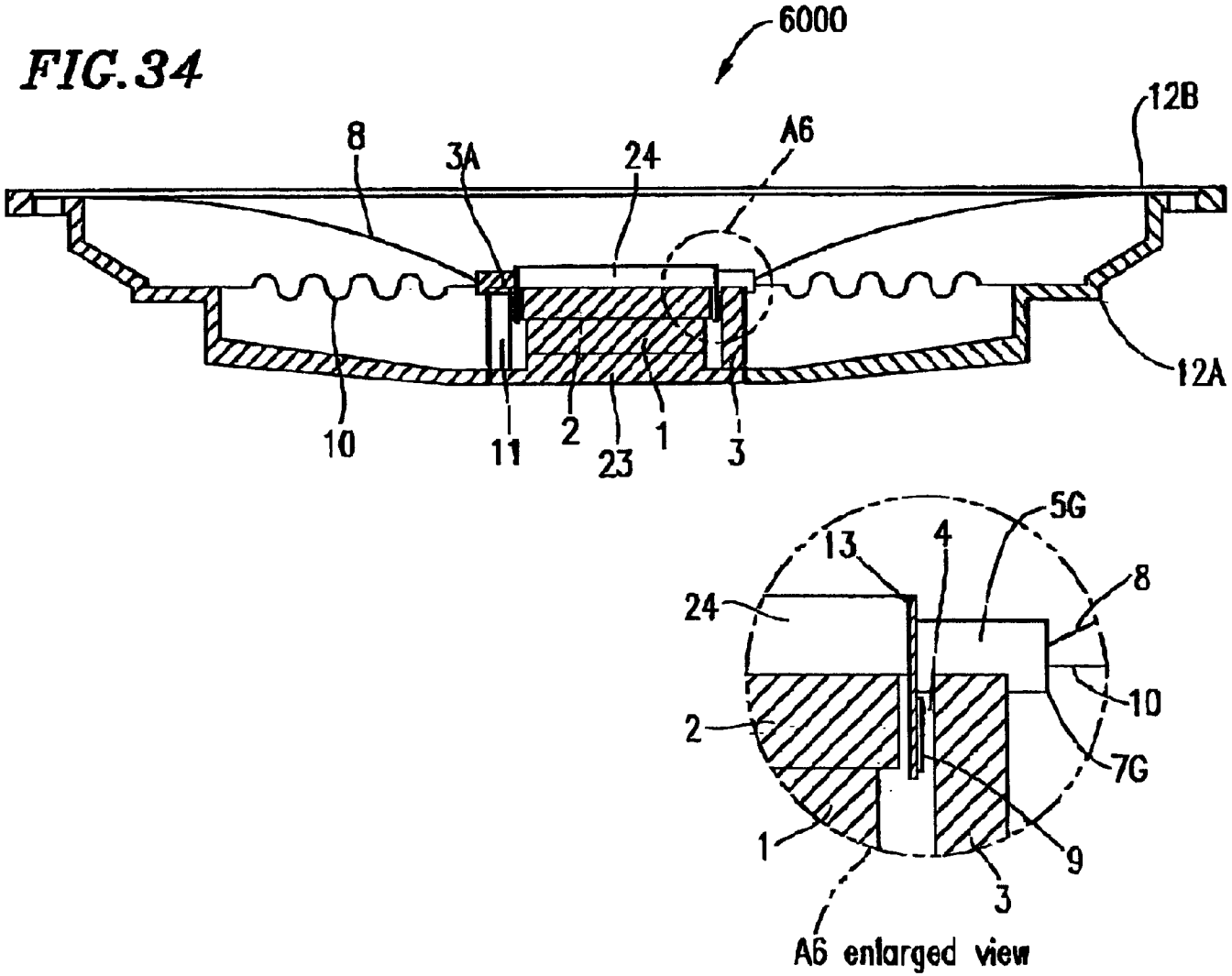
FIG. 34 is a cross-sectional view illustrating a loudspeaker according to Example 6 of the present invention.
Figure 35:
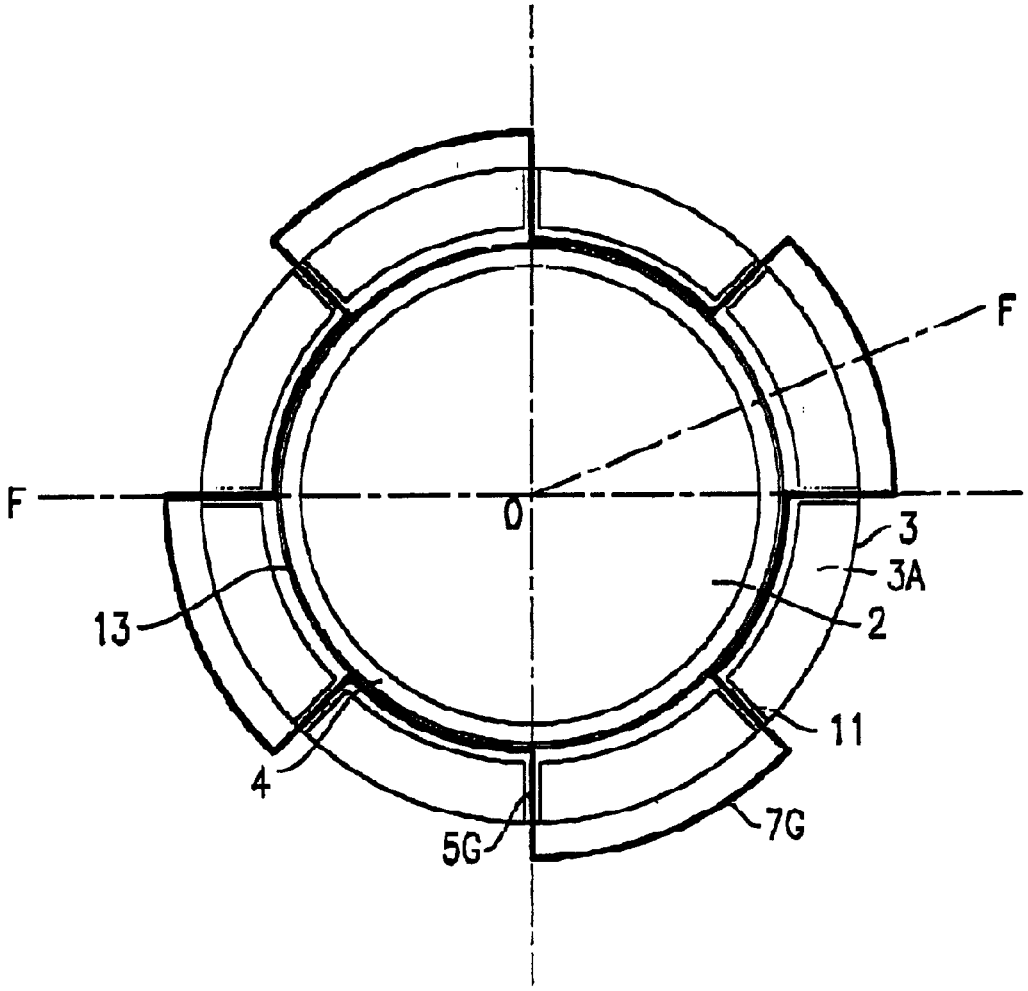
FIG. 35 is a plan view illustrating the loudspeaker according to Example 6 of the present invention in the neighborhood of a coupling member.

FIG. 34 is a cross-sectional view illustrating a loudspeaker 6000 according to Example 6 of the present invention. FIG. 35 is a plan view showing a coupling member 7G inserted into slits 11 of a yoke 3 of the loudspeaker 6000. FIG. 34 is a cross-sectional view of FIG. 35 taken at line F-O-F in FIG. 35.

Figure 36:
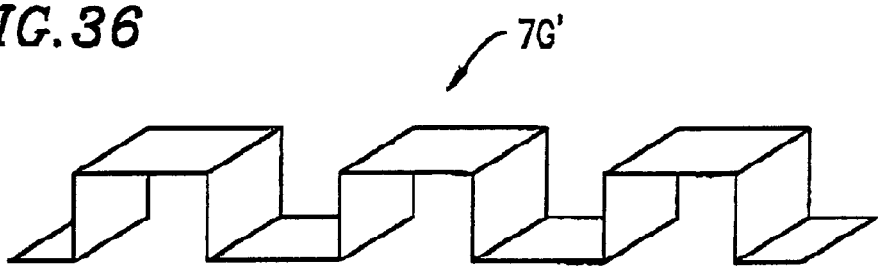
FIG. 36 is a perspective view showing a thin plate from which the coupling member according to Example 6 of the present invention may be formed.

FIG. 36 is a perspective view showing a shaped thin plate 7G', from which the coupling member 7G is to be formed. The coupling member 7G, which can be obtained by folding the thin plate 7G' into a corrugated and annular shape, couples a diaphragm 8 to a voice coil bobbin 13. Regions 5G which extend in parallel to the radial direction of the coupling member 7G are inserted into the slits 11 formed in the yoke 3.

The coupling member 7G can be obtained by winding a thin plate, e.g., the thin plate 7G', around the outer periphery the voice coil bobbin 13 or a voice coil 9. A diaphragm 8 and dampers 10 are affixed to the outer periphery of the coupling member 7G.

The coupling member 7G, which can be formed by folding a single plate-like piece of metal or resin, is easy to process and admits of high productivity. Since a relatively large adhesion area exists between the diaphragm 8 and the dampers 10, a good adhesion strength results. Consequently, problems such as failure of the driving force from the voice coil 9 to be transmitted to the diaphragm 8 or peeling of the diaphragm 8 from the coupling member 7G associated with the diaphragm 8 moving with a large amplitude are prevented.

Since the width of the slits 11 can be reduced in accordance with the thickness of the coupling member 7G, the yoke 3 can have an increased volume, so that the magnetic flux density in the magnetic gap 4 can be increased, whereby the driving force can be enhanced.

FIG. 35 illustrates the coupling member 7G being coupled to the diaphragm 8 and the dampers 10 at four positions around its outer periphery, any number of such positions may be provided for ease of production and/or adjustment of the adhesion area.

The yoke 3 and the bottom plate 23 may be formed as an integral piece.

The illustrated loudspeaker 6000 is an internal type magnetic circuit, i.e., the magnet 1 is located inside the yoke 3. Alternatively, as described with respect to Examples 1 to 5, a magnet 1' may be provided around the outer periphery of a center pole 2', and a plurality of slits 11' may be provided in both a magnet 1' and a yoke 3' to compose an external type magnetic circuit.

Figure 38:
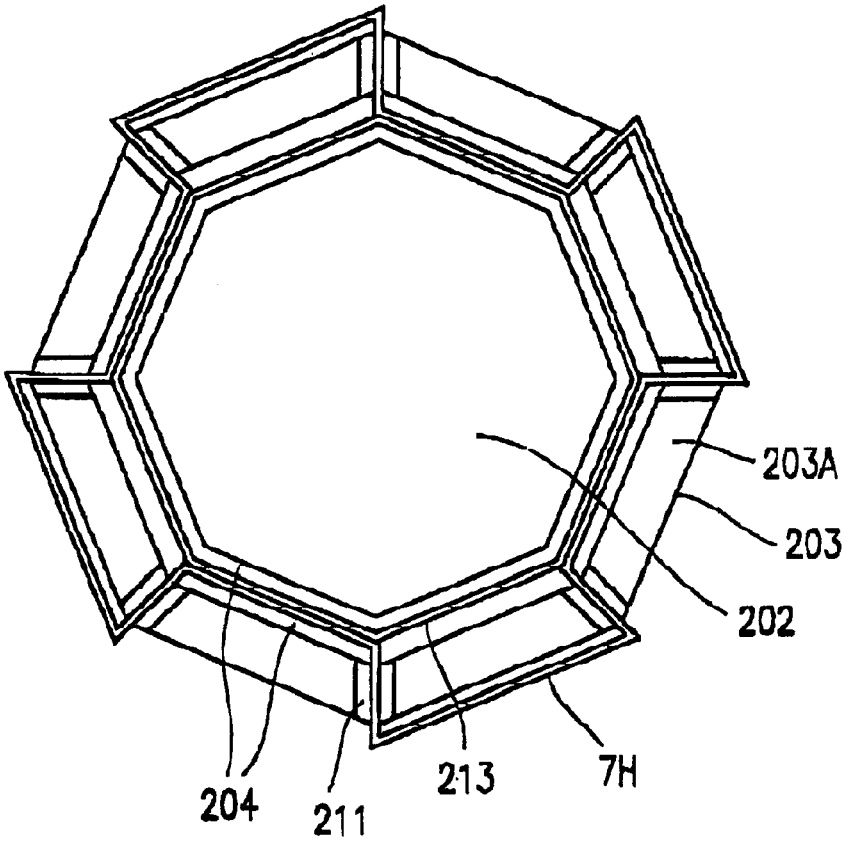
FIG. 38 is a plan view illustrating a modification of the loudspeaker according to Example 6 of the present invention in the neighborhood of a magnetic circuit having an alternative configuration.

As in the plan view of FIG. 38, the magnetic circuit of the loudspeaker 6000 may be formed in a polygonal configuration. In this case, the center pole 2 of the loudspeaker 6000 is replaced by a center pole 202; the voice coil bobbin 13 is replaced by a voice coil bobbin 213; the coupling member 7G is replaced by a coupling member 7H; and the yoke 3 is replaced by a yoke 203. The yoke 203 has slits 211 formed therein. Thus, a polygonal magnetic gap 204 is formed in the structure shown in FIG. 38. Reference numeral 203A denotes an upper face of the yoke 203. The coupling member 7H may be molded into a shape which is in accordance with the polygonal magnetic circuit. The loudspeaker 6000 may be formed in any configuration that allows for easy production.

Figure 37:
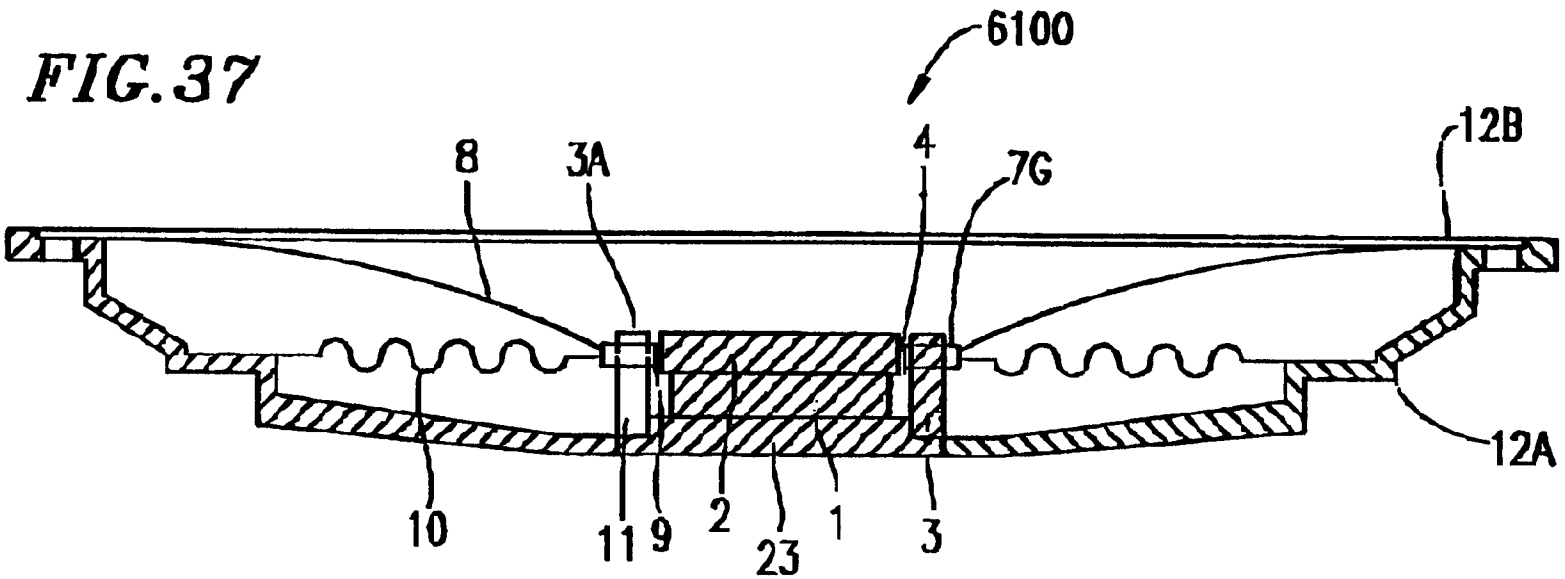
FIG. 37 is a cross-sectional view illustrating a modification of the loudspeaker according to Example 6 of the present invention.

FIG. 37 is a cross-sectional view illustrating a loudspeaker 6100 including a voice coil 9 provided at the inner periphery of a coupling member 7G. This structure, which allows a voice coil bobbin to omitted, makes for a reduced vibrating system mass, and enhanced performance of the loudspeaker 6100. Moreover, since a thin plate of the coupling member 7G is directly coupled to the voice coil 9, the voice coil 9 can be cooled more effectively. As a result, a withstand input level of the loudspeaker 6100 can be improved.

Thus, according to the present invention, a single type of coupling member can always be used for various types of voice coils having different wire diameters, which result in different voice coil outer diameters. This presents the advantages of lower production cost and ease of storage and management of component parts. Since a coupling member having a small mass and adequate strength is provided while allowing for a sufficient vibration amplitude, a loudspeaker which has a reduced profile, and in which the coupling member is prevented from undergoing mechanical destruction, can be provided.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A loudspeaker comprising:

a bottom plate;

a center pole provided upwardly from the bottom plate;

a yoke surrounding the center pole and having a plurality of slits;

a magnet for providing a magnetic flux for the center pole and the yoke;

a coil provided between the center pole and the yoke;

a first annular member for supporting the coil;

a plurality of support members for supporting the first annular member, the plurality of support members being inserted into the plurality of slits; and a diaphragm supported by the plurality of support members, wherein upper faces of the plurality of support members gradually decrease in height in a direction away from the first annular member, and wherein a lower face of the coil is located below a position at which the diaphragm is supported by the plurality of support members.

2. A loudspeaker according to claim 1, wherein the lower face of the coil is located below lower faces of the plurality of support members.

3. A loudspeaker according to claim 1, wherein the coil is provided at an outer periphery of the first annular member.

4. A loudspeaker according to claim 1, further comprising a plurality of dampers for supporting the plurality of support members.

5. A loudspeaker according to claim 4, further comprising a third annular member provided between the plurality of support members and the plurality of dampers, wherein the plurality of dampers support the plurality of support members via the third annular member.

6. A loudspeaker according to claim 5, wherein the plurality of support members and the third annular member are formed as an integral piece.

7. A loudspeaker according to claim 5, further comprising a second annular member provided between the plurality of support members and the first annular member, wherein the plurality of support members support the first annular member via the second annular member.

8. A loudspeaker according to claim 1, wherein the plurality of support members each have a plate-like shape.

9. A loudspeaker according to claim 1, further comprising a second annular member provided between the plurality of support members and the first annular member, wherein the plurality of support members support the first annular member via the second annular member.

10. A loudspeaker according to claim 9, wherein the plurality of support members and the second annular member are formed as an integral piece.

11. A loudspeaker according to claim 1, wherein the plurality of support members and the first annular member are formed as an integral piece.

12. A loudspeaker according to claim 1, further comprising a third annular member provided between the plurality of support members and the diaphragm, wherein the plurality of support members support the diaphragm via the third annular member.

13. A loudspeaker according to claim 12, wherein the plurality of support members and the third annular member are formed as an integral piece.

14. A loudspeaker according to claim 12, further comprising a second annular member provided between the plurality of support members and the first annular member, wherein the plurality of support members support the first annular member via the second annular member.

15. A loudspeaker according to claim 1, wherein the magnet is provided between the bottom plate and the center pole.

16. A loudspeaker according to claim 1, wherein the bottom plate and the yoke are formed as an integral piece.

17. A loudspeaker according to claim 1, wherein the magnet surrounds the center pole.

18. A loudspeaker according to claim 17, wherein:

the magnet has a plurality of slits; and the plurality of slits of the magnet are disposed so as to be aligned with the plurality of slits of the yoke.

19. A loudspeaker according to claim 1, wherein the bottom plate and the center pole are formed as an integral piece.

20. A loudspeaker according to claim 1, wherein:

the first annular member is supported at a first end of each of the plurality of support members, and the diaphragm is supported at a second end of each of the plurality of support members; and a lower face of each of the plurality of support members has a stepped configuration such that the lower face is lower at the second end than at the first end.

21. A loudspeaker according to claim 1, further comprising a cover provided so as to cover an upper face of the center pole.

22. A loudspeaker according to claim 21, wherein the cover and the first annular member are formed as an integral piece.

23. A loudspeaker comprising:

a bottom plate;

a center pole provided upwardly from the bottom plate;

a yoke surrounding the center pole and having a plurality of slits;

a magnet for providing a magnetic flux for the center pole and the yoke;

a coil provided between the center pole and the yoke;

a first annular member for supporting the coil;

a coupling member comprising a plate material folded into an annular shape having a plurality of protruding portions, the coupling member supporting the first annular member, wherein one of the plurality of protruding portions is inserted into two of the plurality of slits; and a diaphragm supported by the coupling member.

24. A loudspeaker according to claim 23, further comprising a plurality of dampers for supporting the coupling member.

25. A loudspeaker according to claim 23, further comprising a cover provided so as to cover an upper face of the center pole.

26. A loudspeaker according to claim 25, wherein the cover and the first annular member are formed as an integral piece.

27. A loudspeaker comprising:

a bottom plate;

a center pole provided upwardly from the bottom plate;

a yoke surrounding the center pole and having a plurality of slits;

a magnet for providing a magnetic flux for the center pole and the yoke;

a coil provided between the center pole and the yoke;

a coupling member comprising a plate material folded into an annular shape having a plurality of protruding portions, the coupling member supporting the coil, wherein one of the plurality of protruding portions is inserted into two of the plurality of slits; and a diaphragm supported by the coupling member.

28. A loudspeaker according to claim 27, further comprising a plurality of dampers for supporting the coupling member.

29. A loudspeaker comprising:

a bottom plate;

a center pole provided upwardly from the bottom plate;

a yoke surrounding the center pole and having a plurality of slits;

a magnet for providing a magnetic flux for the center pole and the yoke;

a coil provided between the center pole and the yoke;

a first annular member for supporting the coil;

a plurality of support members, each having a first end and a second end, for supporting the first annular member at the first ends, the plurality of support members being inserted into the plurality of slits; and a diaphragm supported by the plurality of support members at the second ends, wherein a lower face of each of the plurality of support members has a stepped configuration such that the lower face is lower at the second end than at the first end, and the diaphragm supported by the plurality of support members at the second ends is supported at a position below the lower face, at the first end, of each of the plurality of support members.

30. A loudspeaker according to claim 29, wherein the coil is provided at an outer periphery of the first annular member.

31. A loudspeaker according to claim 29, further comprising a plurality of dampers for supporting the plurality of support members.

32. A loudspeaker according to claim 31, further comprising a third annular member provided between the plurality of support members and the plurality of dampers, wherein the plurality of dampers support the plurality of support members via the third annular member.

33. A loudspeaker according to claim 32, wherein the plurality of support members and the third annular member are formed as an integral piece.

34. A loudspeaker according to claim 32, further comprising a second annular member provided between the plurality of support members and the first annular member, wherein the plurality of support members are interposed between the second annular member and the third annular member.

35. A loudspeaker according to claim 29, further comprising a second annular member provided between the plurality of support members and the first annular member, wherein the plurality of support members support the first annular member via the second annular member.

36. A loudspeaker according to claim 35, wherein the plurality of support members and the second annular member are formed as an integral piece.

37. A loudspeaker according to claim 29, wherein the plurality of support members and the first annular member are formed as an integral piece.

38. A loudspeaker according to claim 29, further comprising a third annular member provided between the plurality of support members and the diaphragm, wherein the plurality of support members support the diaphragm via the third annular member.

39. A loudspeaker according to claim 38, wherein the plurality of support members and the third annular member are formed as an integral piece.

40. A loudspeaker according to claim 38, further comprising a second annular member provided between the plurality of support members and the first annular member, wherein the plurality of support members are interposed between the second annular member and the third annular member.

41. A loudspeaker according to claim 29, wherein the magnet is provided between the bottom plate and the center pole.

42. A loudspeaker according to claim 29, wherein the bottom plate and the yoke are formed as an integral piece.

43. A loudspeaker according to claim 29, wherein the magnet surrounds the center pole.

44. A loudspeaker according to claim 43, wherein:

the magnet has a plurality of slits; and the plurality of slits of the magnet are disposed so as to be aligned with the plurality of slits of the yoke.

45. A loudspeaker according to claim 29, wherein the bottom plate and the center pole are formed as an integral piece.

46. A loudspeaker according to claim 29, further comprising a thin plate for interconnecting upper faces of at least two of the plurality of support members.

47. A loudspeaker according to claim 29, wherein the first end of each of the plurality of support members has a first height-wise dimension, a first width-wise dimension and a first length-wise dimension, and the second end of each of the plurality of support members has a second height-wise dimension, a second width-wise dimension, and a second length-wise dimension, wherein the second height-wise dimension is greater than the first height-wise dimension.

48. A loudspeaker according to claim 29, further comprising a cover provided so as to cover an upper face of the center pole.

49. A loudspeaker according to claim 48, wherein the cover and the first annular member are formed as an integral piece.

50. A loudspeaker comprising:

a bottom plate;

a center pole provided upwardly from the bottom plate;

a yoke surrounding the center pole and having a plurality of slits;

a magnet for providing a magnetic flux for the center pole and the yoke;

a coil provided between the center pole and the yoke;

a first annular member for supporting the coil;

a plurality of support members for supporting the first annular member, the plurality of support members being inserted into the plurality of slits;

a diaphragm supported by the plurality of support members; and a second annular member provided between the plurality of support members and the diaphragm, wherein the plurality of support members support the diaphragm via the second annular member, and wherein a plurality of thin plates for reinforcing the second annular member are provided at at least one of an inner periphery and an outer periphery of the second annular member.

51. A loudspeaker according to claim 50, wherein each of the plurality of support members has a constant dimension in a direction of vibration of the diaphragm.

52. A loudspeaker according to claim 50, wherein the second annular member and the plurality of thin plates are formed as an integral piece.

53. A loudspeaker according to claim 50, further comprising a third annular member provided between the plurality of support members and the first annular member, wherein the plurality of support members are interposed between the second annular member and the third annular member.

54. A loudspeaker according to claim 50, further comprising a thin plate for interconnecting upper faces of at least two of the plurality of support members.

55. A loudspeaker according to claim 50, wherein:

the first annular member is supported at a first end of each of the plurality of support members, and the diaphragm is supported at a second end of each of the plurality of support members; and a lower face of each of the plurality of support members has a stepped configuration such that the lower face is lower at the second end than at the first end.

56. A loudspeaker according to claim 55, wherein the second end of each of the plurality of support members has height-wise dimension greater than a height-wise dimension of the first end of the support member.

57. A loudspeaker according to claim 50, wherein:

the plurality of thin plates are provided at an outer periphery of the second annular member;

the number of thin plates is equal to the number of support members; and the plurality of thin plates are positioned on extensions of the plurality of support members along a radial direction of the first annular member.

58. A loudspeaker according to claim 50, wherein:

the plurality of thin plates are provided at an inner periphery of the second annular member; and at least one of the plurality of thin plates is provided in closer proximity to one of the plurality of support members than to others of the plurality of thin plates.

59. A loudspeaker according to claim 50, wherein a lower face of the coil is located below lower faces of the plurality of support members.

60. A loudspeaker according to claim 50, wherein the coil is provided at an outer periphery of the first annular member.

61. A loudspeaker according to claim 50, further comprising a cover provided so as to cover an upper face of the center pole.

62. A loudspeaker according to claim 61, wherein the cover and the first annular member are formed as an integral piece.

* * * * *